US010774693B2

(12) United States Patent
Baltrucki et al.

(10) Patent No.: US 10,774,693 B2
(45) Date of Patent: Sep. 15, 2020

(54) VARIABLE LENGTH PISTON ASSEMBLIES FOR ENGINE VALVE ACTUATION SYSTEMS

(71) Applicant: Jacobs Vehicle Systems, Inc., Bloomfield, CT (US)

(72) Inventors: Justin D. Baltrucki, Canton, CT (US); David M. Ferreira, Glastonbury, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 16/151,803

(22) Filed: Oct. 4, 2018

(65) Prior Publication Data

US 2020/0109648 A1 Apr. 9, 2020

(51) Int. Cl.
*F01L 1/18* (2006.01)
*F01L 1/14* (2006.01)
(Continued)

(52) U.S. Cl.
CPC ..... *F01L 1/182* (2013.01); *F01L 1/146* (2013.01); *F01L 13/0005* (2013.01);
(Continued)

(58) Field of Classification Search
CPC ..... F01L 1/182; F01L 13/065; F01L 13/0005; F01L 1/146; F01L 13/0031;
(Continued)

(56) References Cited

U.S. PATENT DOCUMENTS 1,757,721 A * 5/1930 Klemm, Jr. ..... F01L 1/22 123/90.52
2,343,067 A * 2/1944 Luce ..... F01L 1/22 123/90.45
(Continued)

FOREIGN PATENT DOCUMENTS

DE 102016211998 A1 * 1/2018 ..... F01L 1/022
JP 58098611 A * 6/1983 ..... F01L 1/2405

OTHER PUBLICATIONS

International Search Report for International Application No. PCT/US2019/054631 dated Jan. 7, 2020, 3 pages.
(Continued)

*Primary Examiner* — Patrick Hamo
*Assistant Examiner* — Wesley G Harris
(74) *Attorney, Agent, or Firm* — Moreno IP Law LLC

(57) ABSTRACT

Variable-length assemblies, including lost motion assemblies eliminate hydraulic or pneumatic working fluids for operation in internal combustion engine valve trains and may be integrated into valve rocker arm pivots. An example piston and actuating plate are provided with working surfaces that interact when the actuating plate is rotated relative to the piston. The working surfaces include ramped transition portions and may include upper and lower flat portions. A shallow ramp angle prevents counter-rotation of the actuating plate under load. Actuating assemblies include an actuating solenoid includes a plunger that engages and pivots the actuating arm to cause rotation of the actuating plate relative to the piston and changes the state of the lost motion assembly from an "off" state, where motion may be absorbed, to an "on" state where the lost motion assembly is rigid and does not absorb motion.

29 Claims, 31 Drawing Sheets
(2 of 31 Drawing Sheet(s) Filed in Color)

(51) Int. Cl.
*F01L 13/00* (2006.01)
*F01L 13/06* (2006.01)

(52) U.S. Cl.
CPC ..... *F01L 13/0031* (2013.01); *F01L 13/065* (2013.01); *F01L 2305/02* (2020.05)

(58) Field of Classification Search
CPC ... F01L 2105/02; F01L 2105/00; F01L 1/185; F01L 1/181; F01L 1/22; F01L 1/24; F01L 1/2405
USPC ..... 123/90.16, 90.15, 90.39, 90.43
See application file for complete search history.

(56) References Cited

U.S. PATENT DOCUMENTS 4,221,199 A 9/1980 Buuck et al.
4,256,070 A 3/1981 Mueller
4,305,356 A 12/1981 Walsh
4,380,219 A 4/1983 Walsh
4,414,935 A * 11/1983 Curtis ..... F01L 13/0005 123/198 F
5,645,025 A * 7/1997 Caya ..... F01L 1/183 123/193.5
5,893,344 A 4/1999 Church
6,354,265 B1 3/2002 Hampton et al.
7,458,350 B2 12/2008 Diggs
7,617,807 B2 11/2009 Diggs et al.
7,905,208 B2 3/2011 Ruggiero et al.
2002/0174849 A1* 11/2002 Ruggiero ..... F01L 13/06 123/319
2006/0196457 A1 9/2006 Shattuck et al.
2012/0186546 A1 7/2012 Cecur et al.
2018/0306073 A1* 10/2018 McCarthy, Jr. ..... F01L 13/0036

OTHER PUBLICATIONS

Written Opinion of the ISA for International Application No. PCT/US2019/054631 dated Jan. 7, 2020, 3 pages.

* cited by examiner

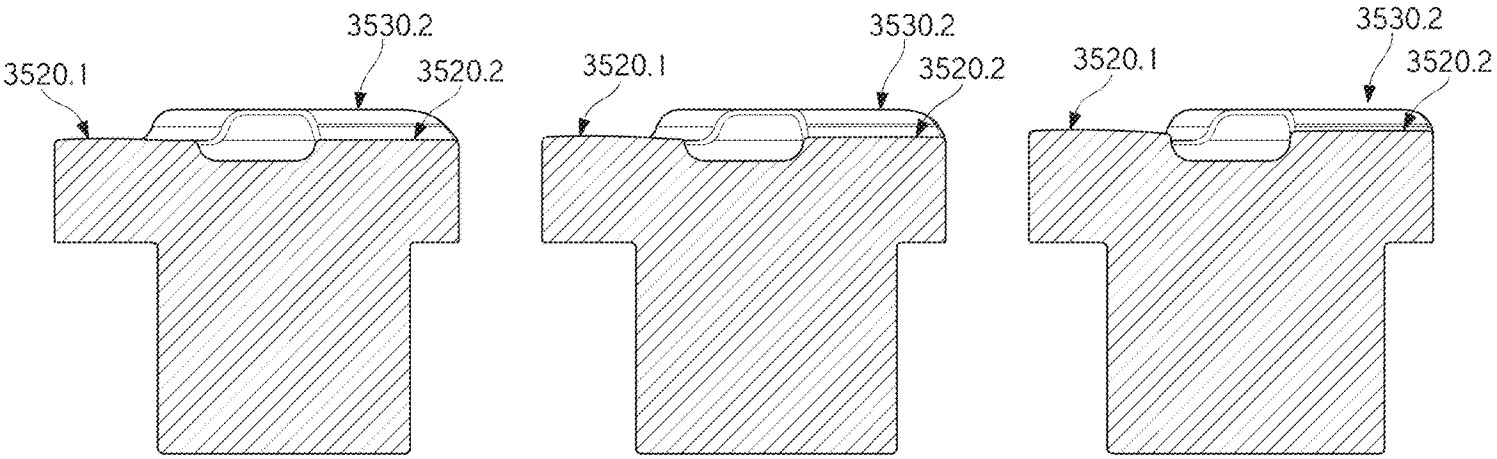
FIG. 39A
FIG. 39B
FIG. 39C
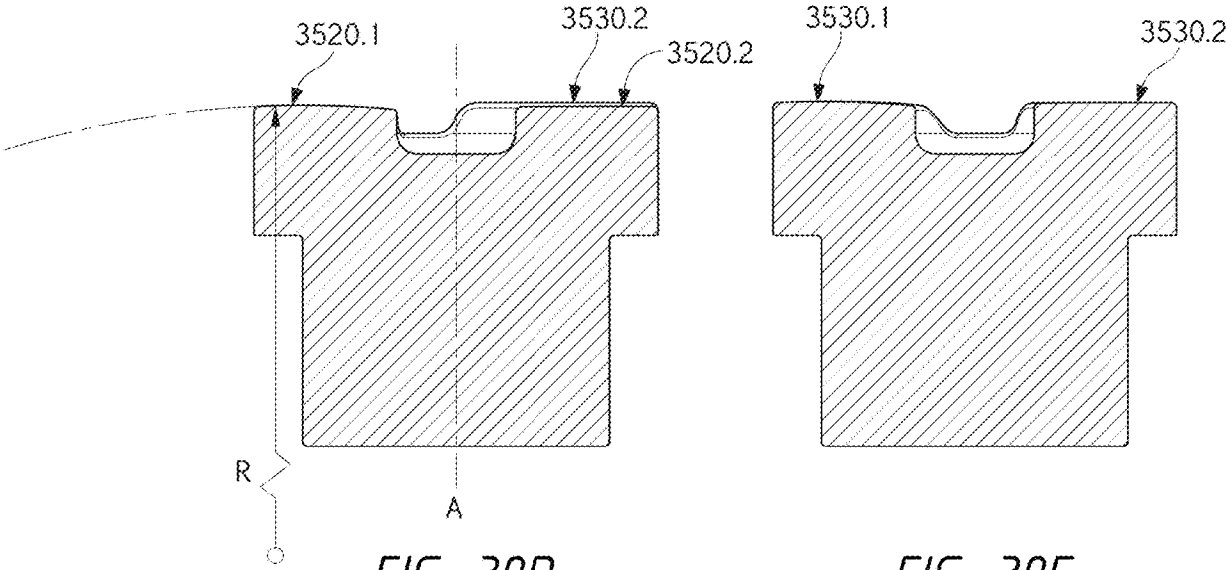
FIG. 39D
FIG. 39E

VARIABLE LENGTH PISTON ASSEMBLIES FOR ENGINE VALVE ACTUATION SYSTEMS

FIELD

This disclosure relates generally to systems and methods for actuating valves in internal combustion engines. More particularly, this disclosure relates to variable length piston assemblies that may be used in various applications, including applications relating to lost motion assemblies in engine valve trains and lost motion features that may be integrated into valve rocker arms and rocker arm pivots. The disclosure further relates to variable length piston assemblies that may be used in bleeder brake systems.

BACKGROUND

Internal combustion engines require valve actuation systems to control the flow of combustible components, typically fuel and air, to one or more combustion chambers during operation. Such systems control the motion and timing of intake and exhaust valves during engine operation. In a positive power mode, intake valves are opened to admit fuel and air into a cylinder for combustion and exhaust valves are subsequently opened to allow combustion products to escape the cylinder. This operation is typically called a "main event" operation of the valves.

In addition to positive power main event operation, valve actuation systems may be configured to facilitate "auxiliary events" during engine operation. These may include, but are not limited to, engine braking, exhaust gas recirculation (EGR) and internal exhaust gas recirculation (iEGR). During these auxiliary events, valve timing and motion may be controlled to cause the engine to recirculate exhaust gases to achieve improved emissions, or to cause the engine to absorb energy from the engine load in engine braking operations.

Valve movement during main event positive power modes of operation is typically controlled by one or more rotating cams as motion sources. Cam followers, push rods, rocker arms and other elements disposed in a valve train provide for direct transfer of motion from the cam surface to the valves. For auxiliary events, "lost motion" devices may be utilized in the valve train to facilitate auxiliary event valve movement. Lost motion devices refer to a class of technical solutions in which valve motion is modified compared to the motion that would otherwise occur as a result of actuation by a respective cam surface alone. Lost motion devices may include devices whose length, rigidity or compressibility is varied and controlled in order to facilitate the selective occurrence of auxiliary events in addition to, or as an alternative to, main event operation of valves. Lost motion devices may be viewed as a subclass of a larger category of variable length piston assemblies, which may have application beyond those involving lost motion.

Prior art lost motion systems typically rely upon hydraulic or pneumatic working fluids (i.e., oil or air) for their operation. As a result, such systems are not readily adaptable to engines that do not utilize such working fluids, or that use such fluids at relatively low pressures that aren't sufficient to actuate lost motion systems.

In addition to lost motion systems, prior art valve actuation systems may require variable length elements that may be actuated to provide other functions, such as braking action provided by bleeder brake components. Such variable length elements may be used to selectively actuate engine valves to cause a bleeder brake operation to occur.

With the use of mechanically interacting elements and surfaces, another challenge in the art is to provide actuating assemblies that can withstand the rapid and repeated cycling and stresses that occur in an engine valve train environment and which reduce the potential for excessive peak stresses to develop during operation.

It would therefore be advantageous to provide systems and methods that address the aforementioned shortcoming and others in the prior art.

SUMMARY

Responsive to the foregoing challenges, Applicants provide various embodiments of variable length assemblies and systems, which may be used in applications involving components that may expand or contract in length, such as lost motion assemblies in engine valve actuation systems, or in other applications, such as bleeder brake actuation, where a variable length device is useful in a valve train.

According to one aspect, lost motion assemblies and systems are provided which eliminate the need for hydraulic or pneumatic working fluids for operation and which facilitate start-stop decompression and rapid cycling during valve system operation. In one embodiment, the lost motion assembly is integrated into a valve rocker arm pivot. A piston or base of the pivot is retained in stationary position within a bore in a pedestal, which may be mounted on an engine cylinder head and may support valve train components for several cylinders. An actuating plate is mounted for rotational movement relative to the piston. A biasing element such as a spring may be disposed in a bore or recess within the piston to provide a biasing force on the actuating plate. The actuating plate may include an actuation post that enables an actuating assembly, which may include a solenoid and an actuating arm mounted for pivoting movement on the pedestal. The piston and actuating plate are provided with working surfaces that interact when the actuating plate is rotated relative to the piston to configure the lost motion assembly in an "off" state, in which motion may be absorbed, and an "on" state in which the lost motion assembly acts as a solid element that transmits full cam motion. In one embodiment, the working surfaces include lower flat portions, ramped transition portions, and upper flat portions.

According to another aspect, the working surfaces may include continuous shallow ramp portions. The ramp angle is shallow enough to prevent counter-rotation of the actuating plate under load from the rocker arm. In this embodiment, flat portions and discontinuities in the working surface may be reduced or eliminated. The shallow ramps of the working surfaces of the actuating plate and piston remain in close contact as the lost motion assembly is actuated, reducing the potential for partial engagement of the contact surfaces and resulting in excessive contact stress.

According to a further aspect, lost motion assemblies may be provided in conjunction with valve train linkages that utilize lash adjusters. The lost motion assembly may include an internal spring which exerts a force on the lost motion assembly actuating plate and piston. The force is sufficient to resist compression of the spring, and thus the lost motion assembly, when forces resulting from the attempted expansion of a lash adjuster are exerted on the valve train. The lost motion assembly stroke may be adjusted using a shim situated between a shoulder on the piston and the pedestal surface or a retaining plate surface. This support structure provides a simple way to adjust the stroke of the lost motion assembly. The spring may engage a spring cap that includes a central circular projection on which the actuating plate may rotate. The spring cap also engages a surface within the bore. The actuating plate may be provided with a small clearance such that when the lost motion assembly piston is in a maximum position (i.e., maximum lift from the shim), the spring counters forces exerted in the valve train by the lash adjuster and the actuating plate remains unloaded. This facilitates actuation of the actuating plate with relatively little force.

According to a further aspect, retaining assemblies for mounting lost motion assemblies are provided. The retaining assembly may include a bore in a pedestal used for mounting rocker arm pivots, rocker arms and other valve actuation components. The piston and actuating plate assembly may be retained in the bore. An anti-rotation key may be provided on the piston body to prevent rotation of the piston within the pedestal. An annular retaining plate may engage a shoulder on the lost motion assembly piston and may be fastened to the pedestal with threaded fasteners to thereby retain the piston and actuating plate assembly within the bore of the pedestal.

According to a further aspect, actuating assemblies for lost motion assemblies are provided. In one embodiment, an actuating post on the actuating plate may extend through a slot formed in the pedestal and may engage an actuating arm that is pivotably mounted on the pedestal. An actuating solenoid includes a plunger that engages and pivots the actuating arm when actuation of the lost motion assembly is desired. This motion rotates the actuating plate relative to the piston and changes the state of the lost motion assembly from an "off" state, where motion may be absorbed, to an "on" state where the lost motion assembly is rigid and does not absorb motion.

According to one aspect, a lost motion assembly comprising a variable-length assembly may be integrated into a rocker arm. A lost motion actuating assembly is also integrated into the rocker arm. The lost motion assembly may be integrated into a motion imparting end of the rocker arm, e.g., where it contacts a valve stem. An actuating plate having a working surface may rotate relative to a piston, which may move axially but not rotationally within the rocker arm. An actuator, which, for example, may be a pneumatic, electromagnetic or hydraulic actuator that utilizes oil flowing within the rocker arm shaft and through ports in the rocker arm may move linearly and, through a linkage, may rotate the actuating plate to change the state of the lost motion assembly from an "off" state, where motion may be absorbed, to an "on" state where the lost motion assembly is rigid and does not absorb motion.

According to a further aspect, a variable-length assembly may be integrated into a bleeder brake housing and used to actuate one or more valves for a bleeder brake application. A fixed plate is secured within the bleeder brake housing and may have an anti-rotation feature. A piston is mounted for rotational and axial movement within the housing. Both the fixed plate and piston have interacting working surfaces that engage one another to provide axial movement of the piston when the piston rotates relative to the fixed plate. An actuating ring with a pin may engage a pocket on the piston and permit rotational movement of the piston. A spring may be disposed on the pin and within the pocket on the piston to provide a relatively low biasing force on the piston in a direction towards the fixed plate and away from the engine valves during positive power operation. A solenoid actuating assembly may be integrated into the housing and provide axial movement which, through a linkage, results in rotational movement of the piston within the housing. Actuation of the solenoid thus results in a state change to the variable-length assembly from an "off" state, where the assembly has a minimum length, to an "on" state where the assembly has a maximum length.

According to a further aspect, a variable-length assembly may include a helical interacting surface in which the helical contact surface has a curved profile in a radial direction. This provides more evenly distributed contact stress across the engaged portion of the surface and avoids high contact stresses near the axis of the piston. With such configurations, maximum or peak contact stress during operation can be reduced.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The patent or application file contains at least one drawing executed in color. Copies of this patent or patent application publication with color drawing(s) will be provided by the Office upon request and payment of the necessary fee.

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto.

Figure 5B:
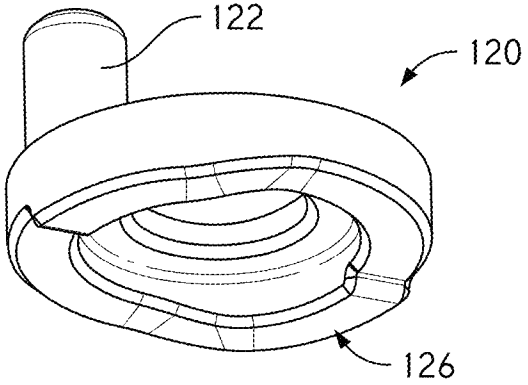
FIGS. 5A and 5B are perspective views of an example actuator piston and actuator plate for a lost motion assembly.
Figure 5A:
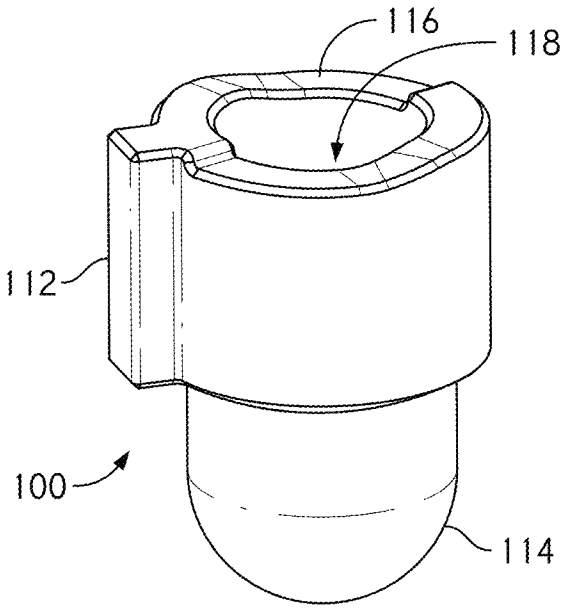

8A and 8B are perspective views showing operational positions of the example actuator piston and actuator plate of FIGS. 5A and 5B.

Figure 9C:
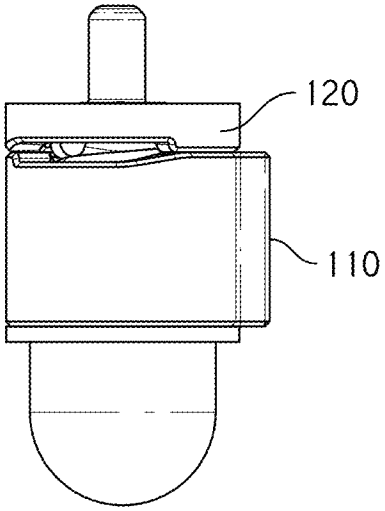
Figure 9B:
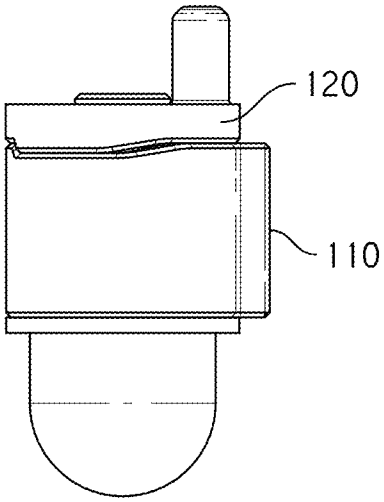
Figure 9A:
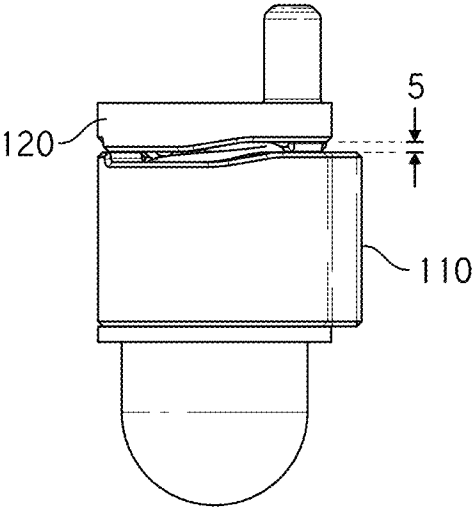

FIGS. 9A, 9B and 9C are elevation views of operational positions of the lost motion assembly of FIGS. 5A and 5B.

Figure 10B:
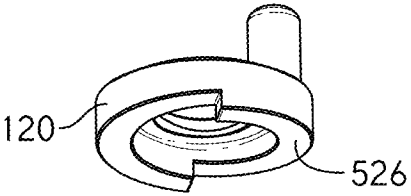
Figure 10A:
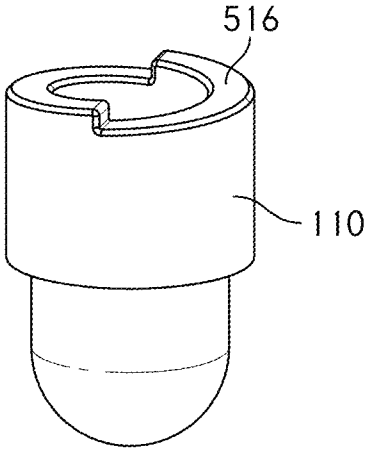

FIGS. 10A and 10B are perspective views of alternative example actuator piston and actuator plate, respectively.

Figure 11A:
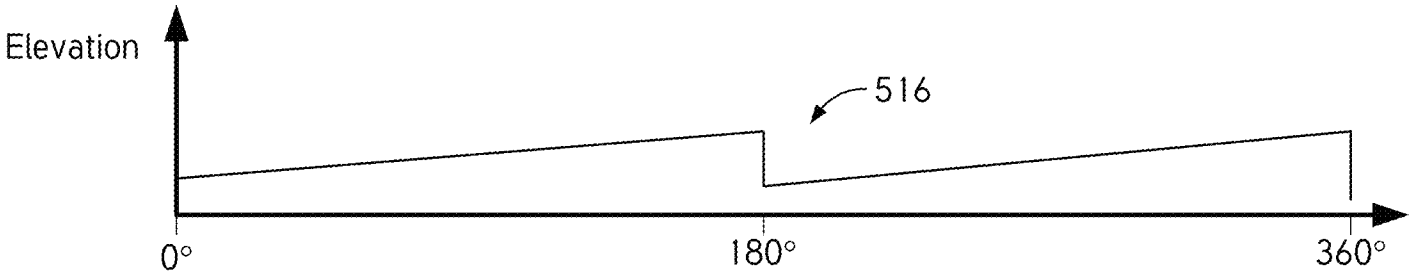
Figure 11B:
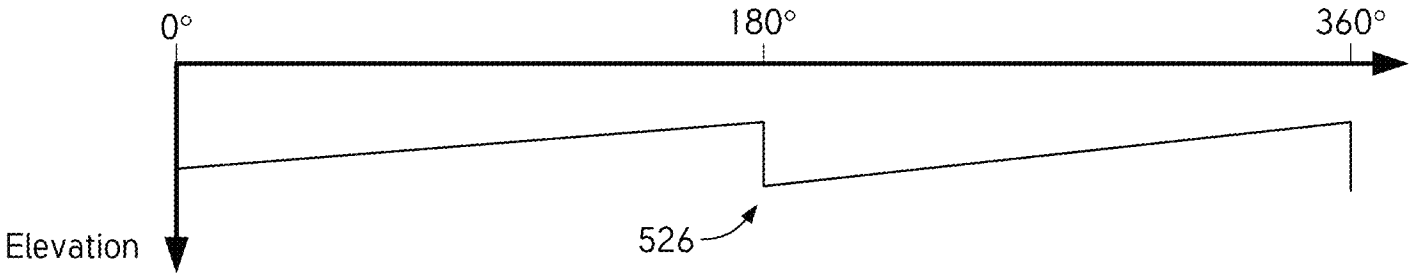

FIGS. 11A and 11B are graphical representations of the working surface profiles of the actuator piston and actuator plate of FIGS. 10A and 10B, respectively.

Figure 12B:
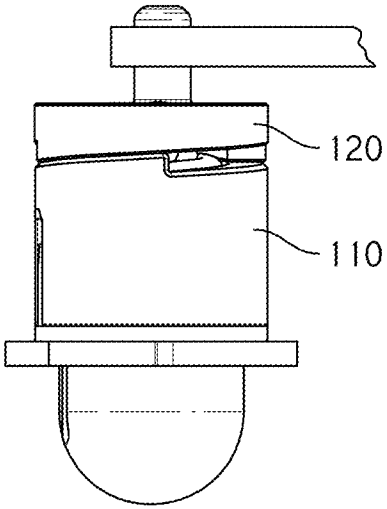
Figure 12A:
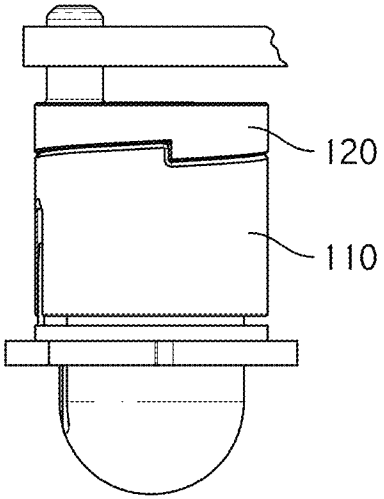
Figure 14D:
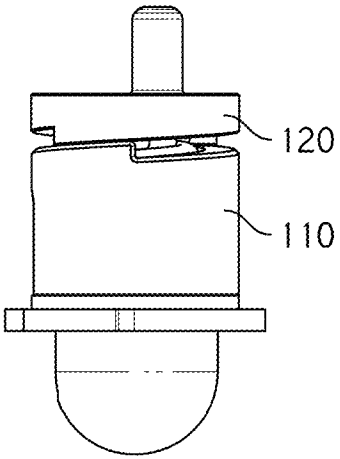
Figure 14C:
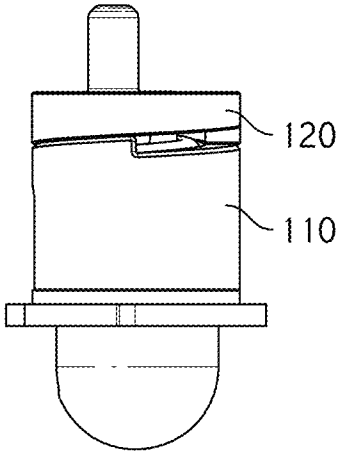
Figure 14B:
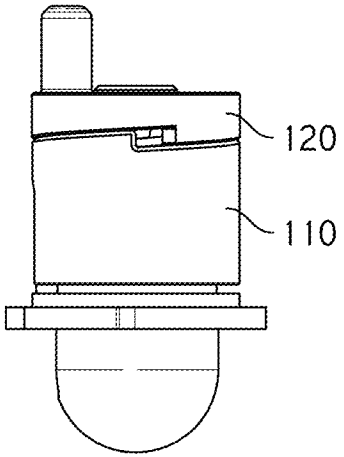
Figure 14A:
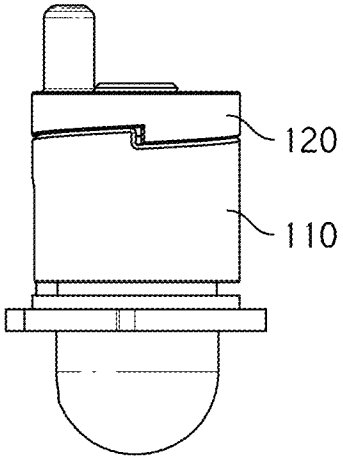

FIGS. 12A and 12B are assembled elevation views showing operational positions of the example actuator piston and actuator plate of FIGS. 10A and 10B.

Figure 13:
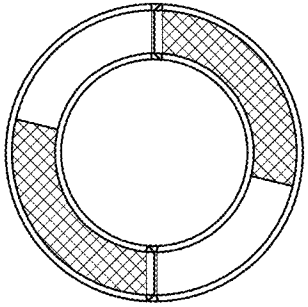

FIG. 13 is a top view showing contact surfaces of the actuator piston of FIG. 10A.

FIGS. 14A, 14B, 14C and 14D are elevation views showing progressive operation of the example actuator piston and actuator plate of FIGS. 10A and 10B.

Figure 15C:
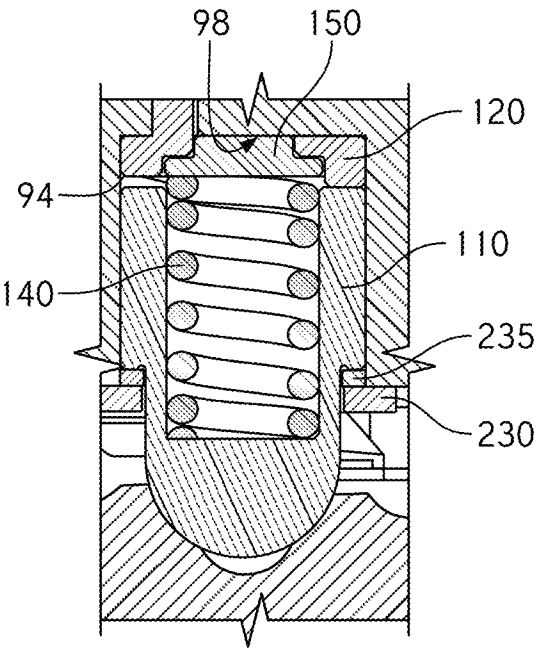
Figure 15B:
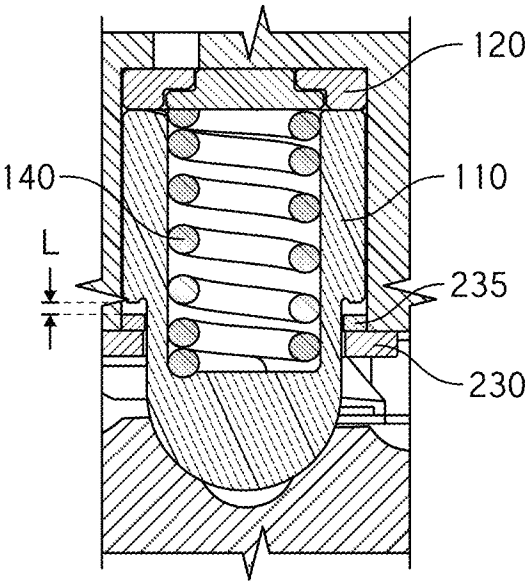
Figure 15A:
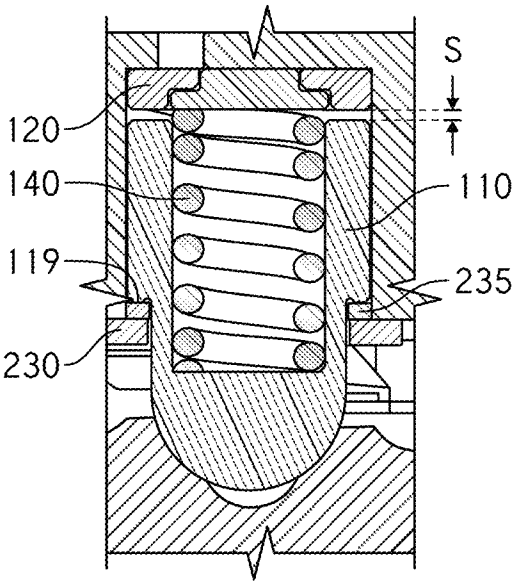

FIGS. 15A, 15B and 15C are cross-sections showing operational positions of an alternative lost motion assembly in a system with lash adjusters.

Figures 16A, 16B, 17:
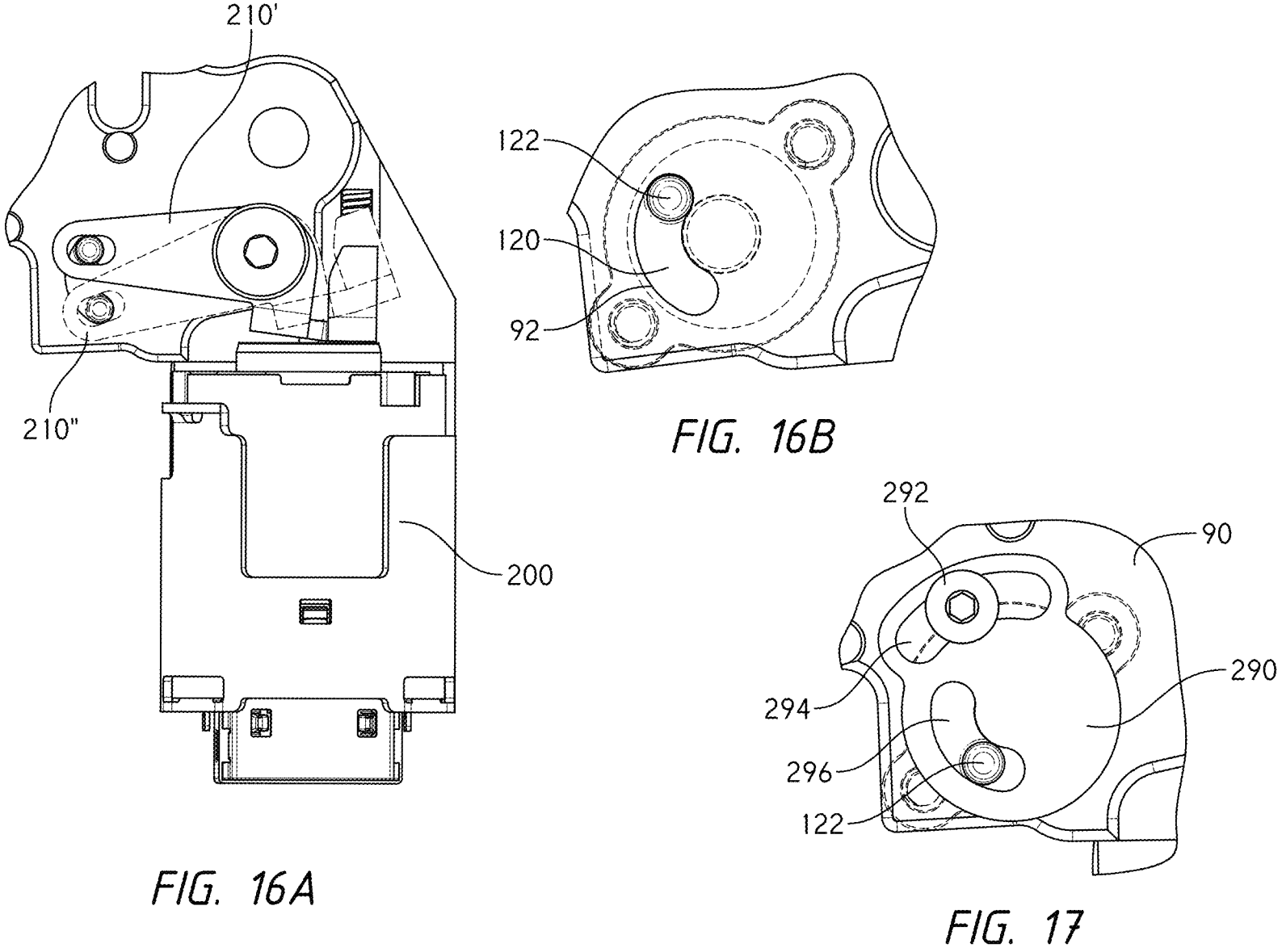

FIGS. 16A and 16B are top views of an actuating system that incorporates a rotary motion limiter for the motion of an actuator plate.

FIG. 17 is a top view of an alternative motion limiter.

Figure 18:
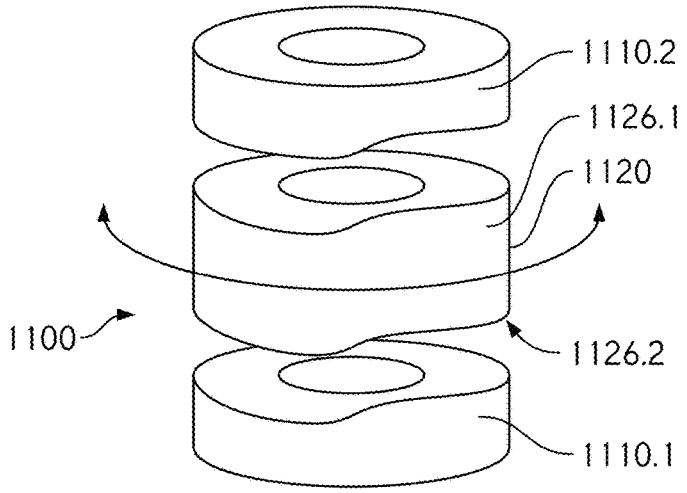

FIG. 18 is a schematic diagram illustrating a three-part lost motion assembly.

Figure 19A:
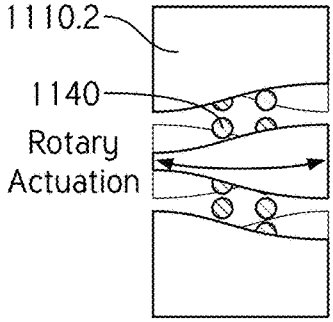
Figure 19B:
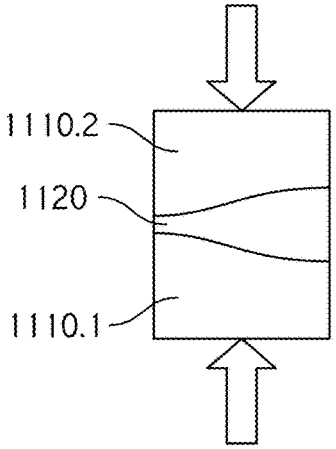
Figure 19C:
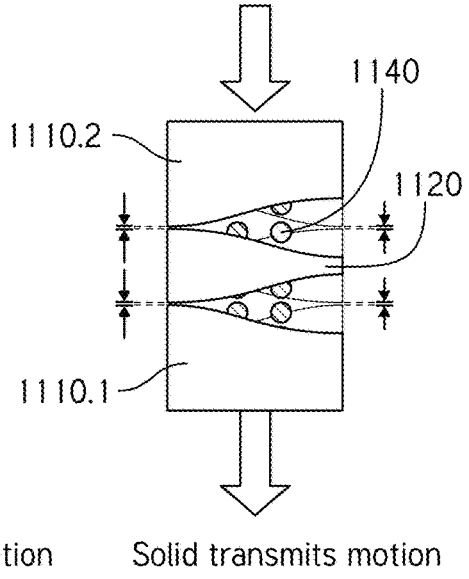

FIGS. 19A, 19B and 19C schematically illustrate operational positions of the lost motion assembly of FIG. 18.

Figure 20:
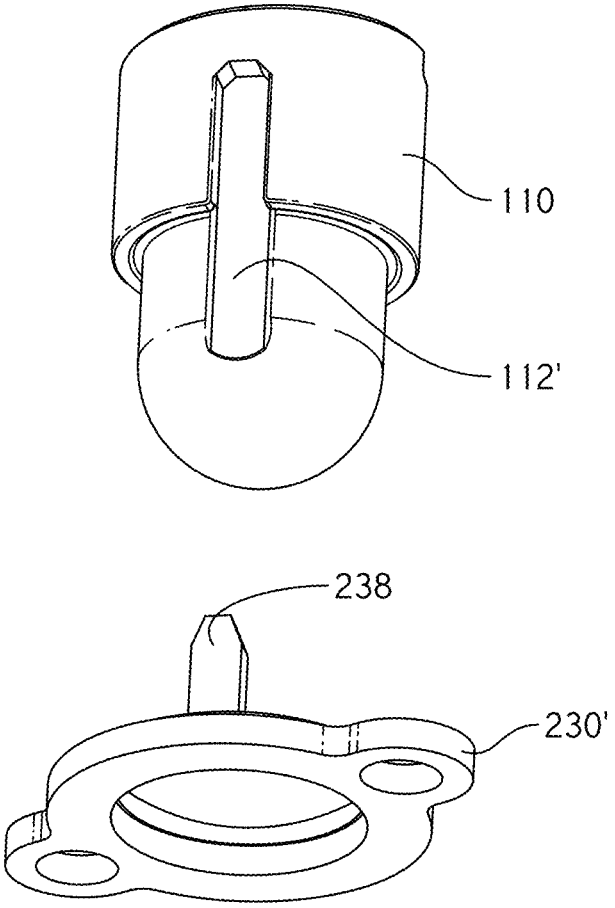

FIG. 20 is an alternative anti-rotation configuration for an actuator piston.

Figure 21:
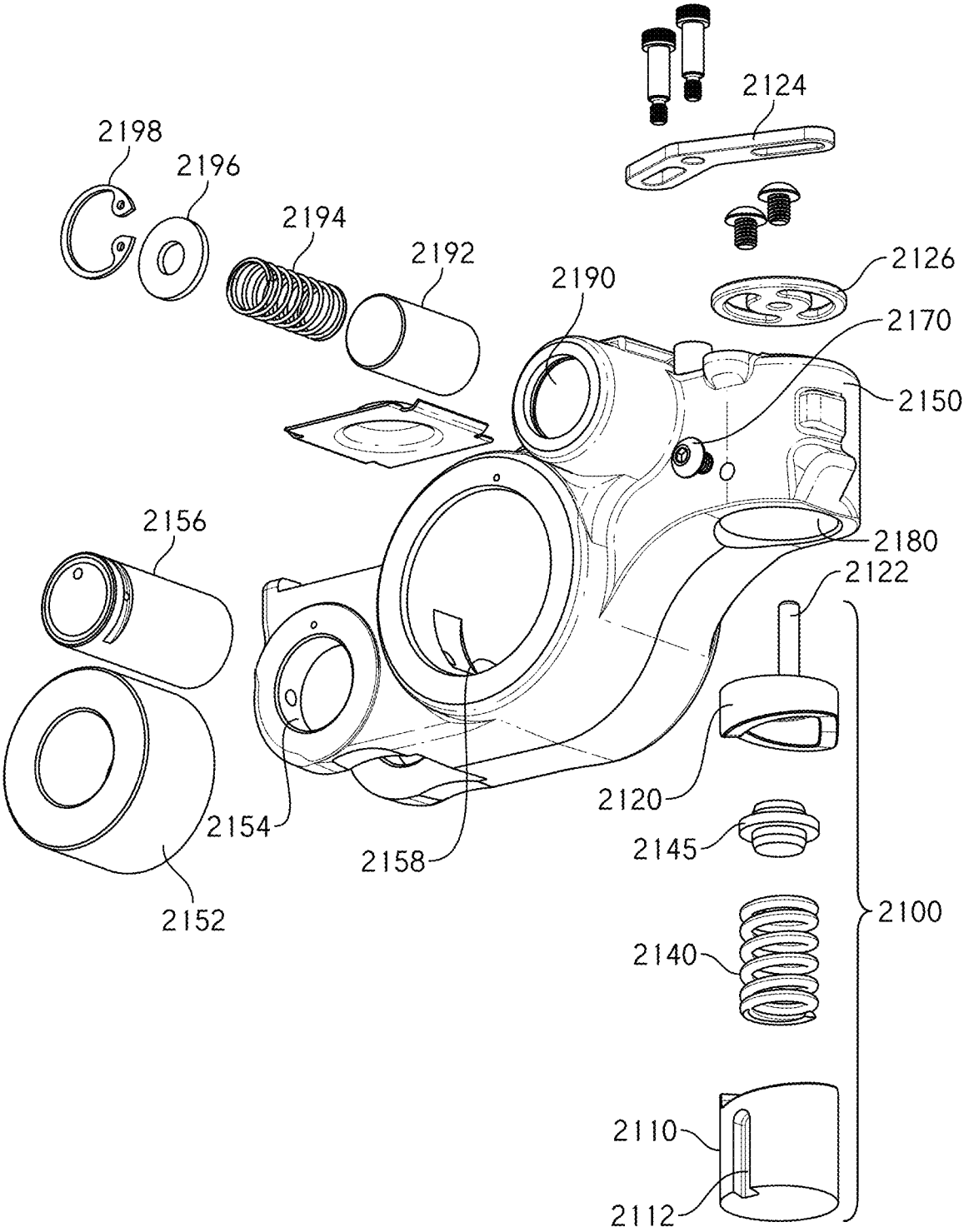

FIG. 21 is an exploded view of a rocker arm having a lost motion assembly and actuating assembly integrated therein.

Figure 22:
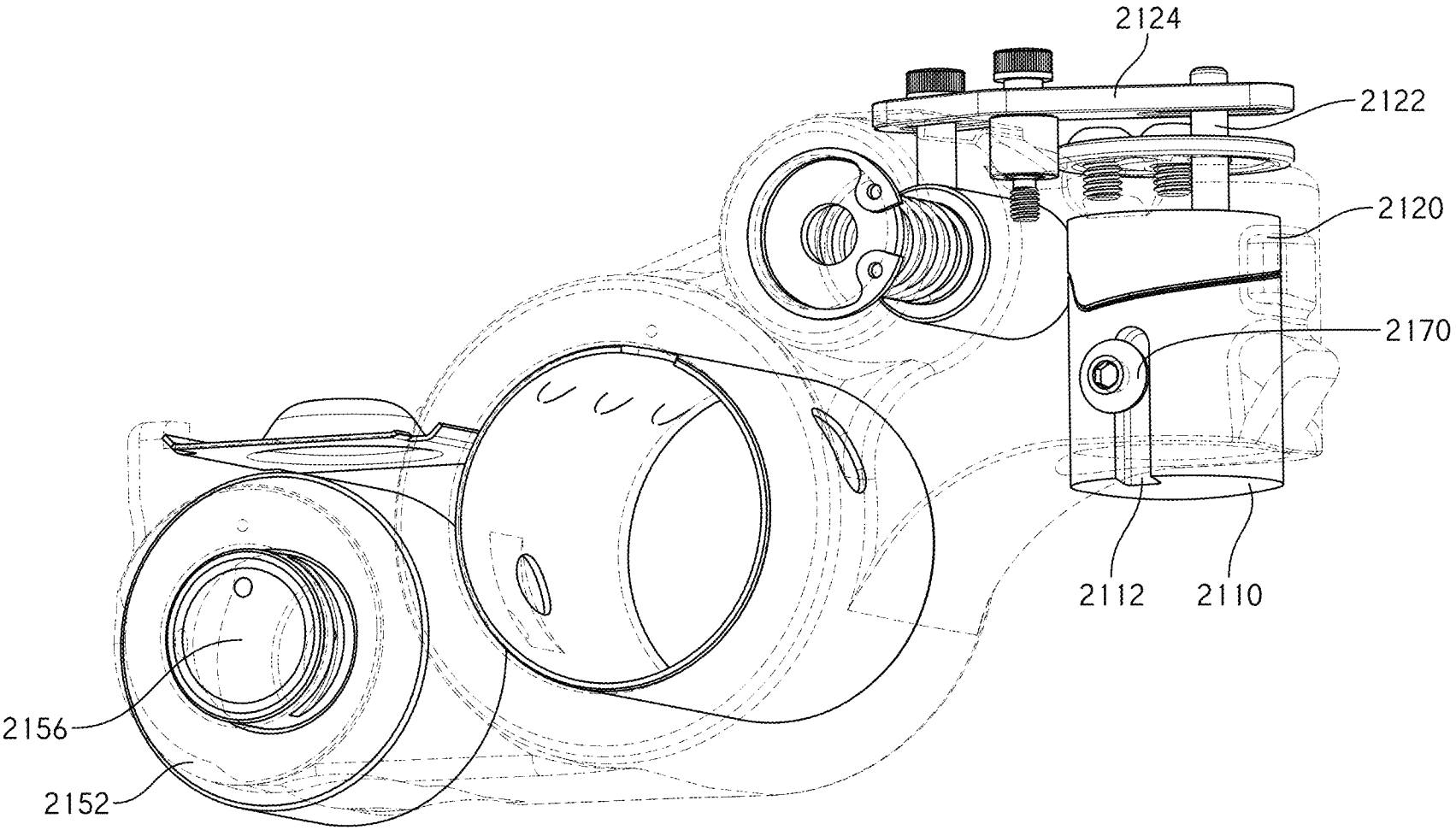

FIG. 22 is an assembled view of the rocker arm of FIG. 21.

Figure 23B:
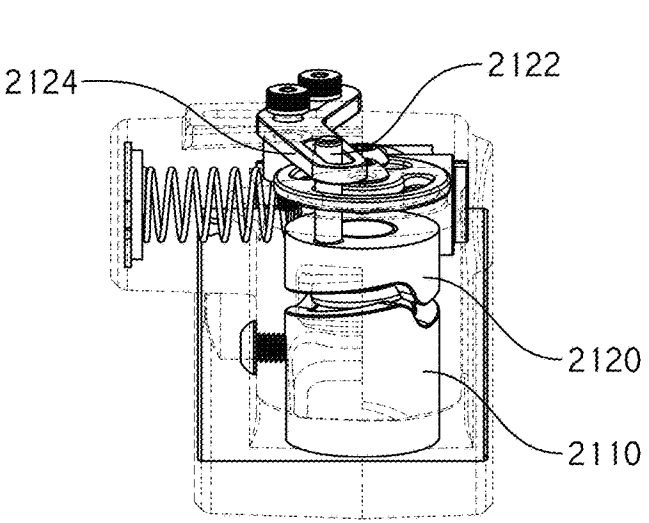
Figure 23D:
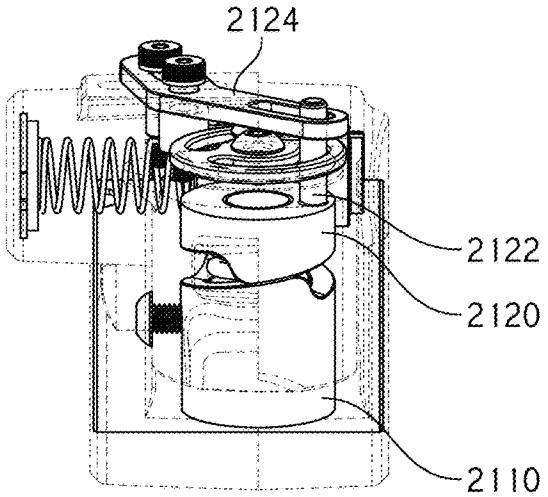
Figure 23A:
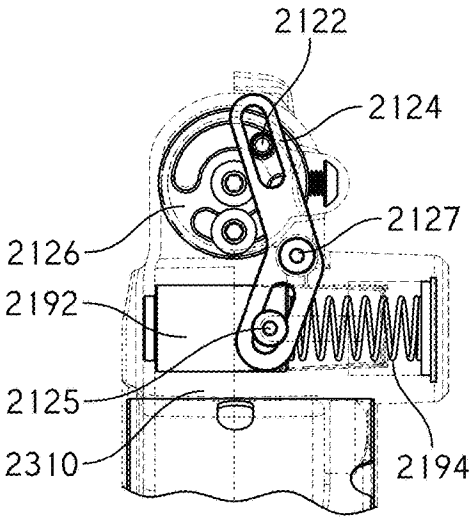

FIGS. 23A and 23B are top and side perspective views of an actuating assembly for the lost motion assembly of FIG. 21, showing an "off" position.

Figure 23C:
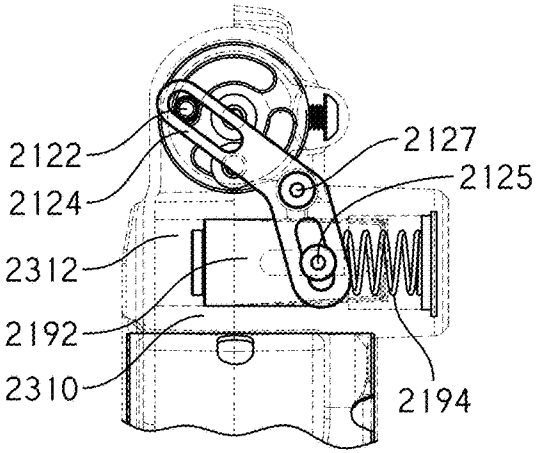

FIGS. 23C and 23D are top and side perspective views of an actuating assembly for the lost motion assembly of FIG. 21, showing an "on" position.

Figure 24:
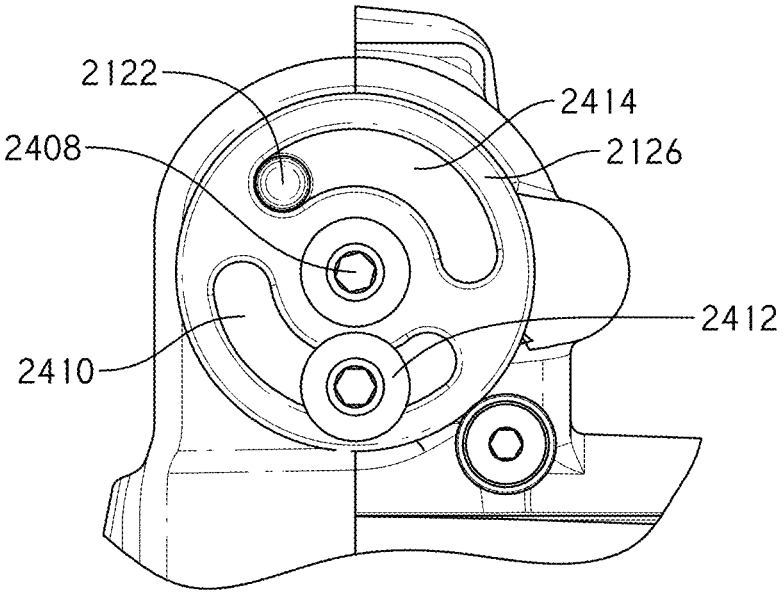

FIG. 24 is a top view of a motion limiter which may function as a lash setting plate on the actuating assembly of FIG. 21.

Figure 25:
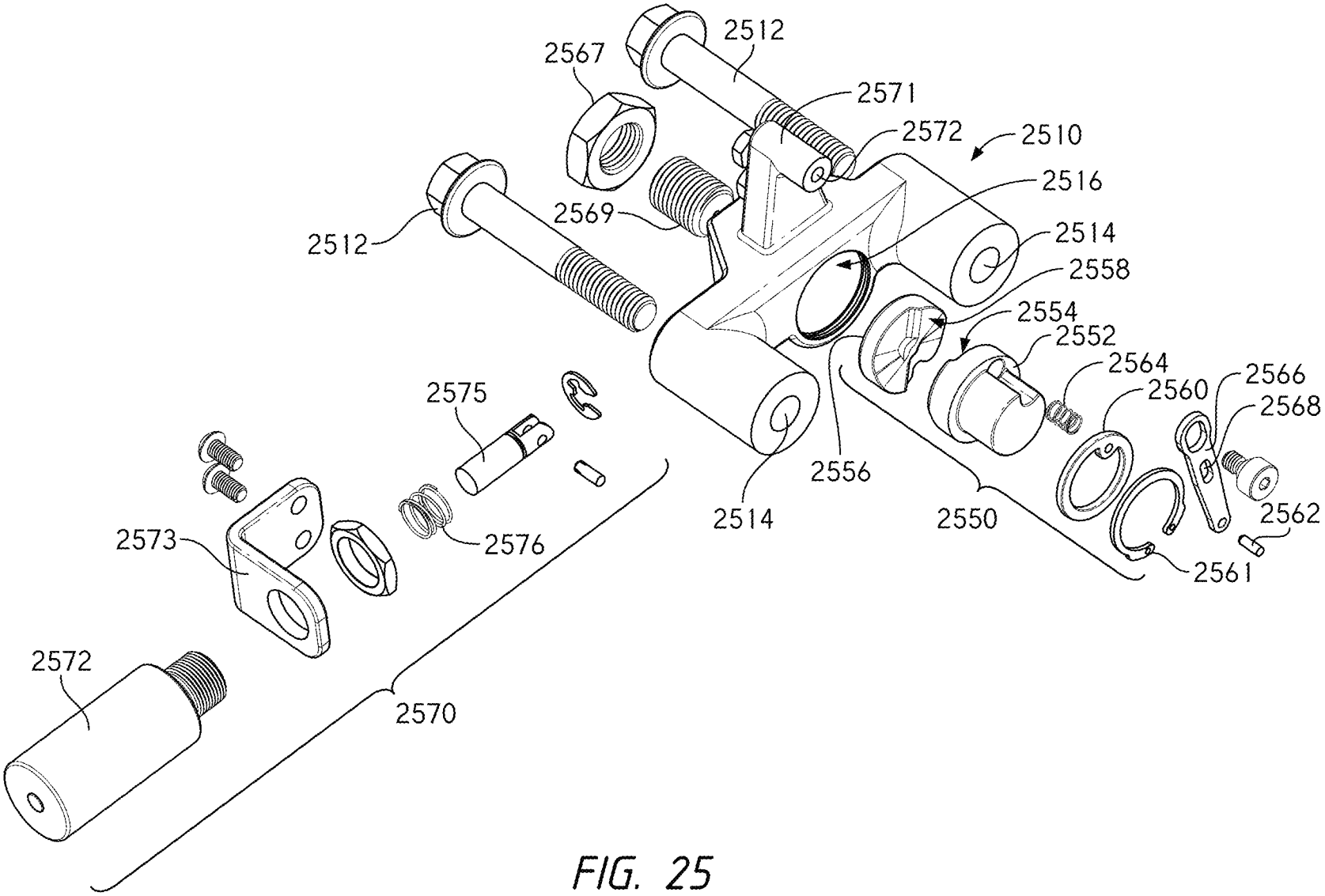

FIG. 25 is an exploded view of a variable-length assembly and actuating assembly integrated into a bleeder brake housing.

Figure 26:
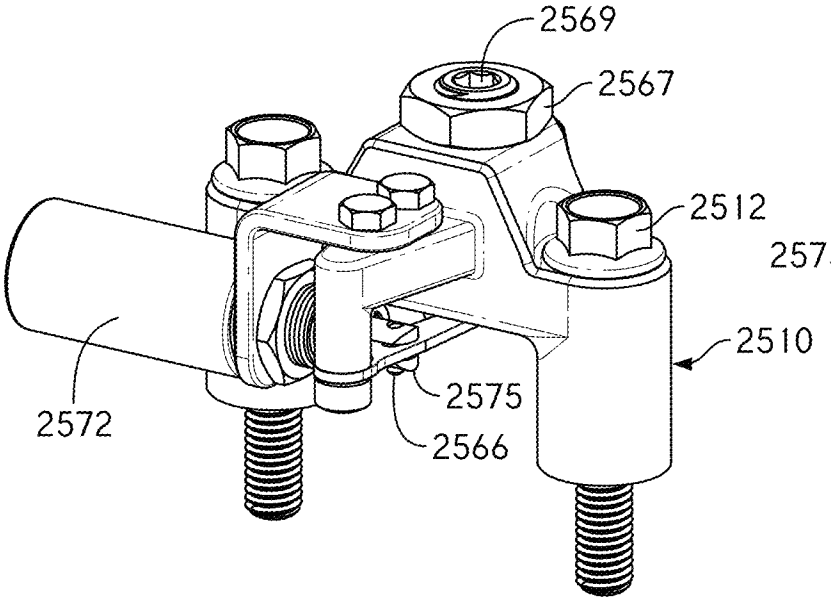

FIG. 26 is an assembled view of the bleeder brake housing, variable-length assembly and actuating assembly of FIG. 25.

Figure 27B:
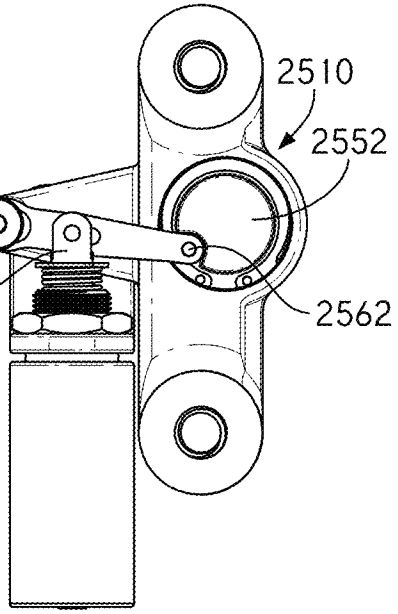
Figure 27A:
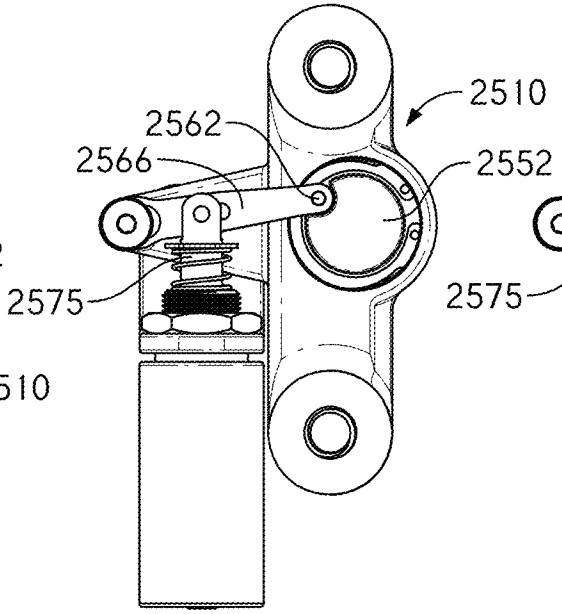

FIGS. 27A and 27B are top views showing "off" and "on" positions of the actuating assembly of FIG. 25.

Figure 28B:
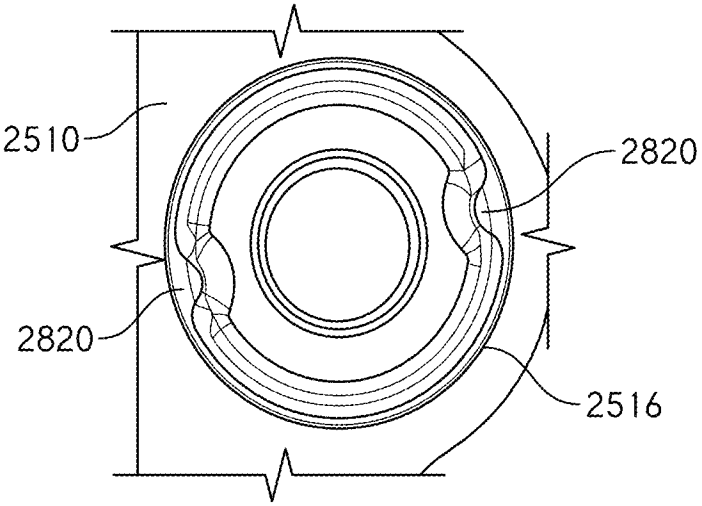
Figure 28A:
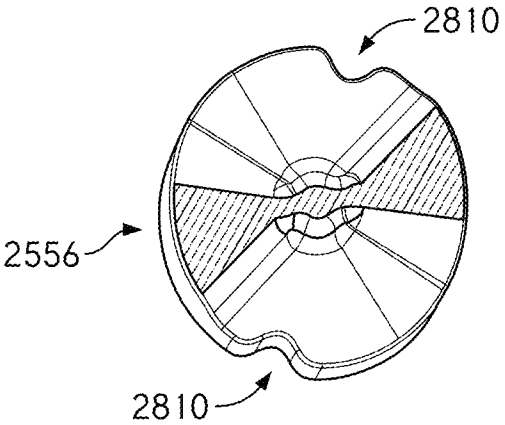

FIGS. 28A and 28B are top views illustrating an example anti-rotation configuration for a fixed plate and a fixed plate receptacle in a bleeder brake housing, respectively.

Figure 29:
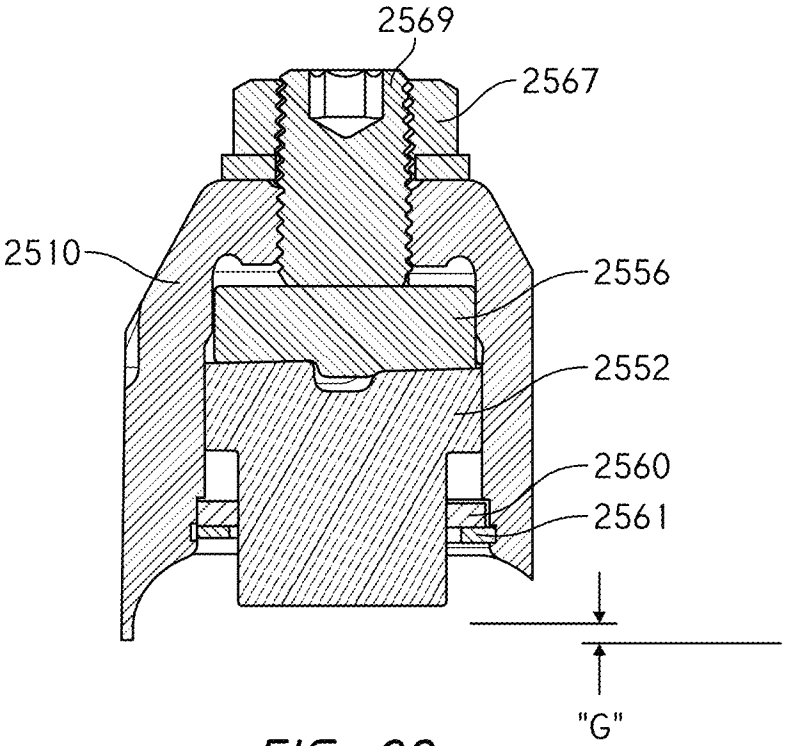

FIG. 29 is a cross-section showing a lash setting adjustment feature for a variable-length assembly in a bleeder brake housing.

Figure 30:
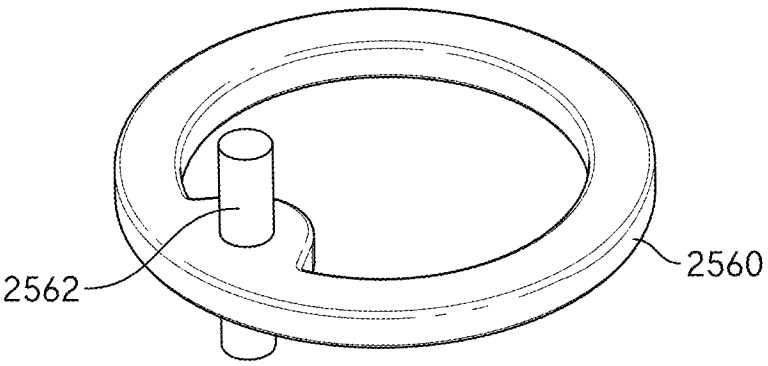

FIG. 30 is a perspective of an alternative example actuating ring for a variable-length assembly.

Figure 31:
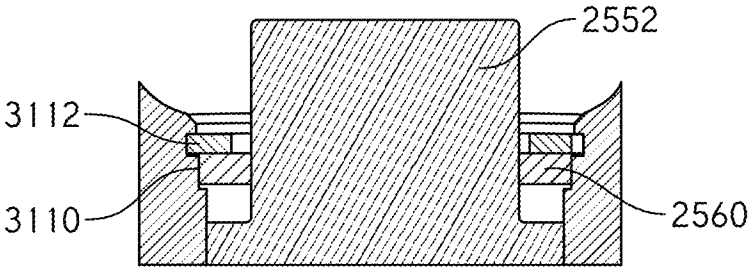

FIG. 31 is a cross-section of an actuating ring mounting configuration for a variable-length assembly.

Figure 32:
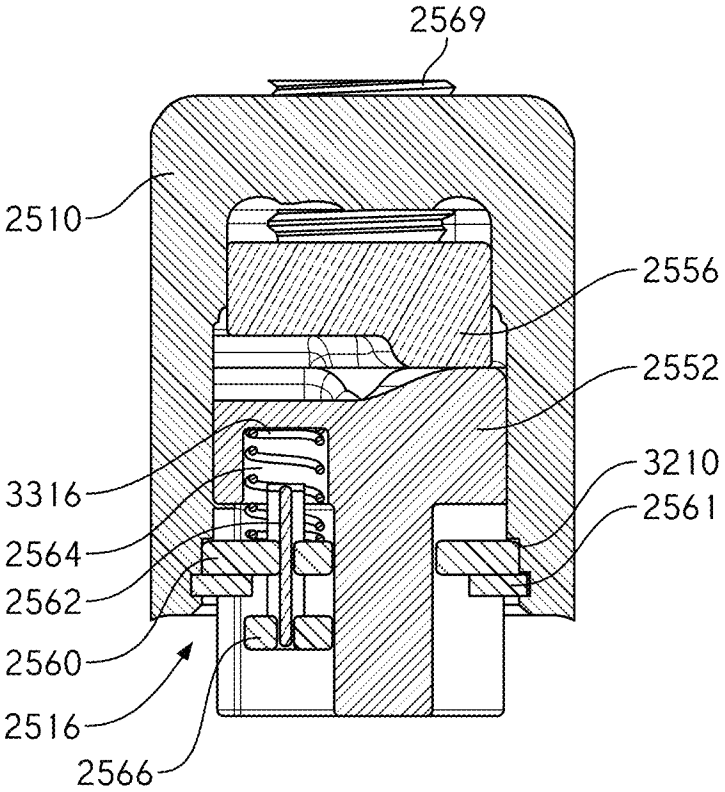

FIG. 32 is a cross-section of a biasing spring configuration and actuating ring mounting configuration for a variable-length assembly.

Figure 33:
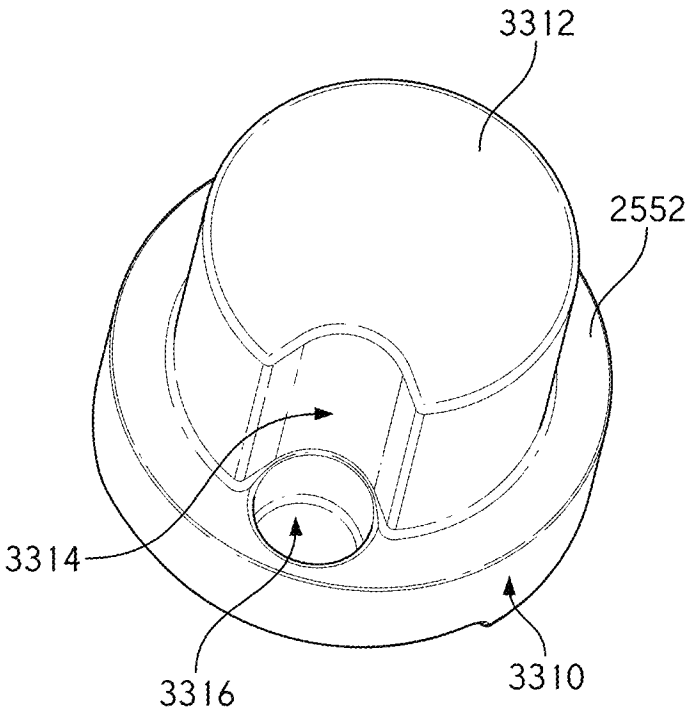

FIG. 33 is a perspective of an example piston that may be used with the mounting configuration of FIG. 32.

Figure 34C:
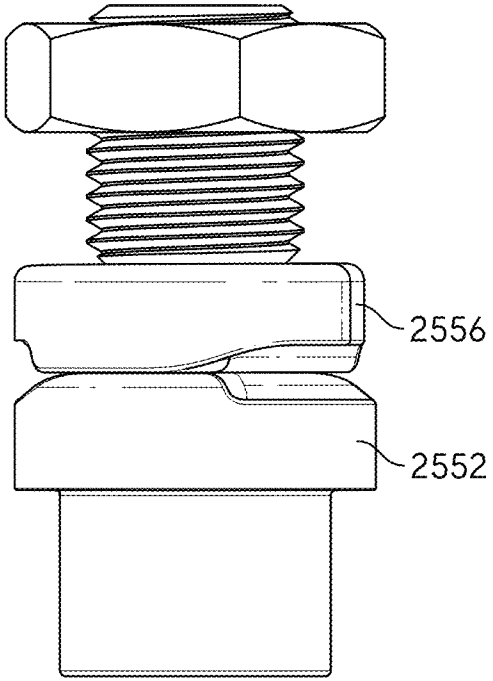
Figure 34B:
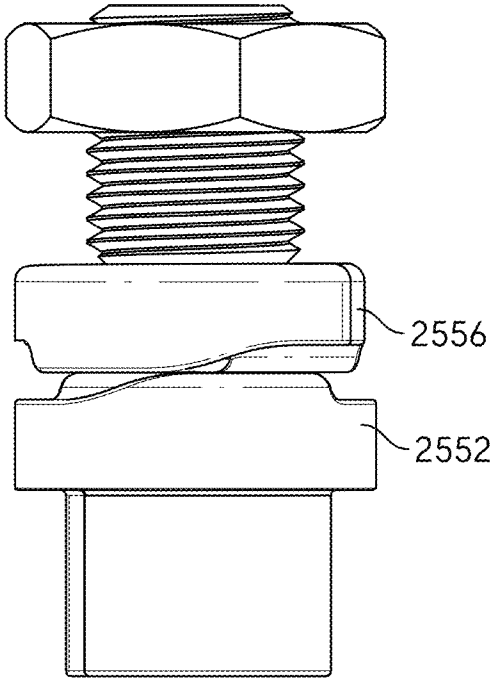
Figure 34A:
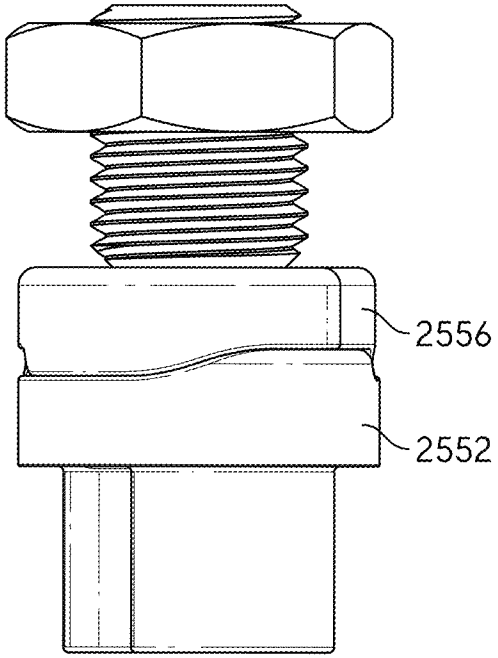

FIGS. 34A, 34B and 34C are views showing respective actuated positions of an example actuator piston.

Figure 35:
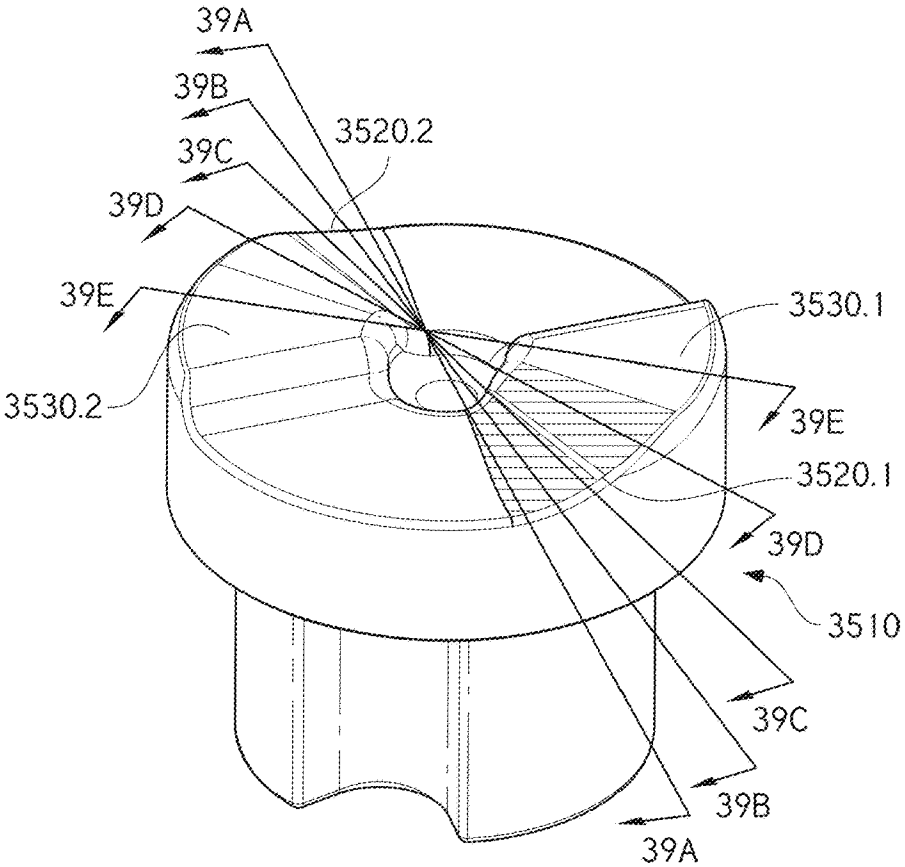

FIG. 35 is a perspective view of an example helical actuator piston surface that may be used in a variable-length assembly.

Figure 36:
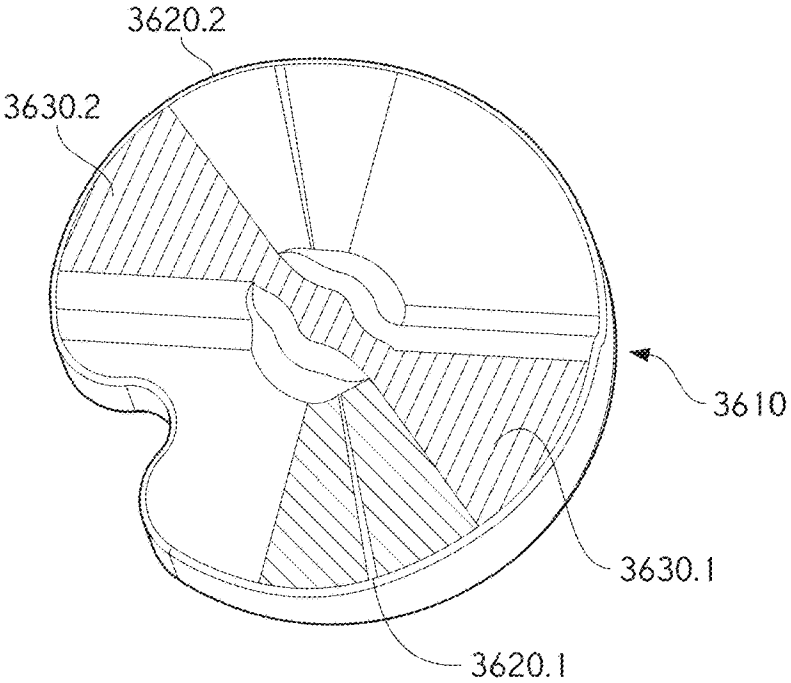

FIG. 36 is a perspective view of an example helical fixed plate surface that may be used in conjunction with the actuator piston surface of FIG. 35.

Figure 37:
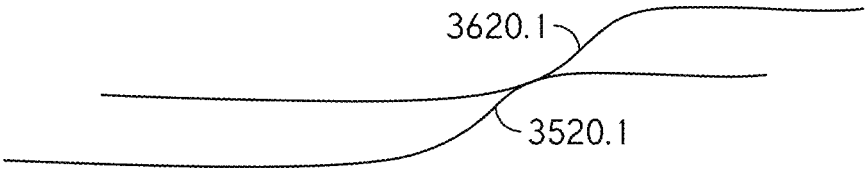

FIG. 37 is a schematic illustration of helical interacting surfaces on a piston and fixed plate.

Figure 38:
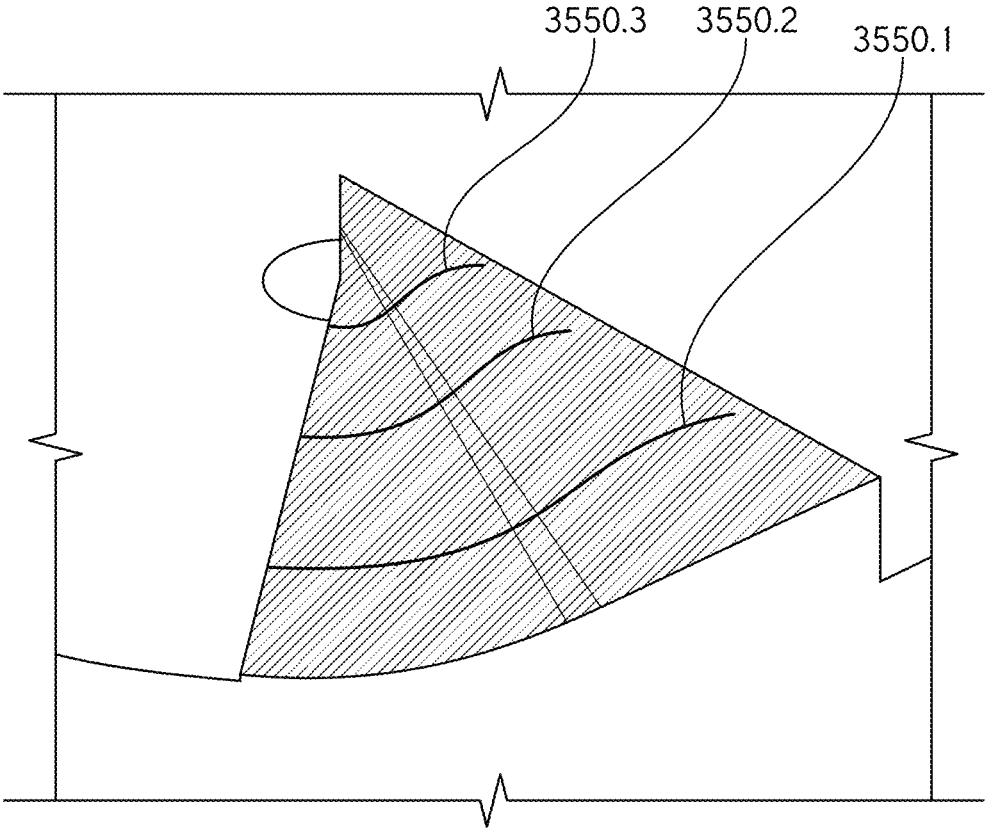

FIG. 38 is a detailed perspective view of a helical piston surface showing contour lines.

FIGS. 39A-39E are cross-sections in radial planes 39A-39A, 39B-39B, 39C-39C, 39D-39D and 39E-39E of FIG. 35, respectively, showing an example helical shape of ramped surfaces on a lost motion assembly piston.

Figure 40A:
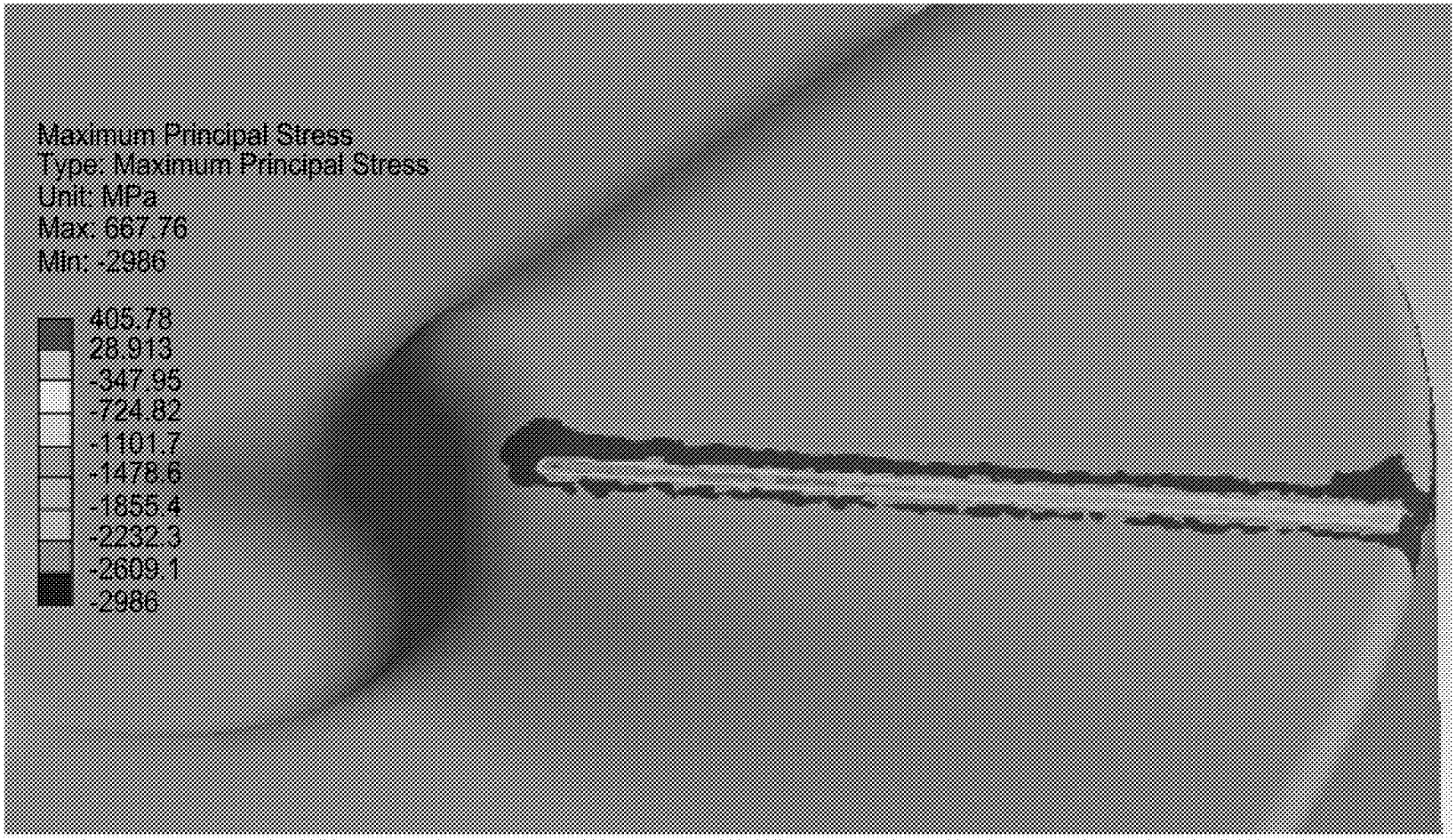
Figure 40B:
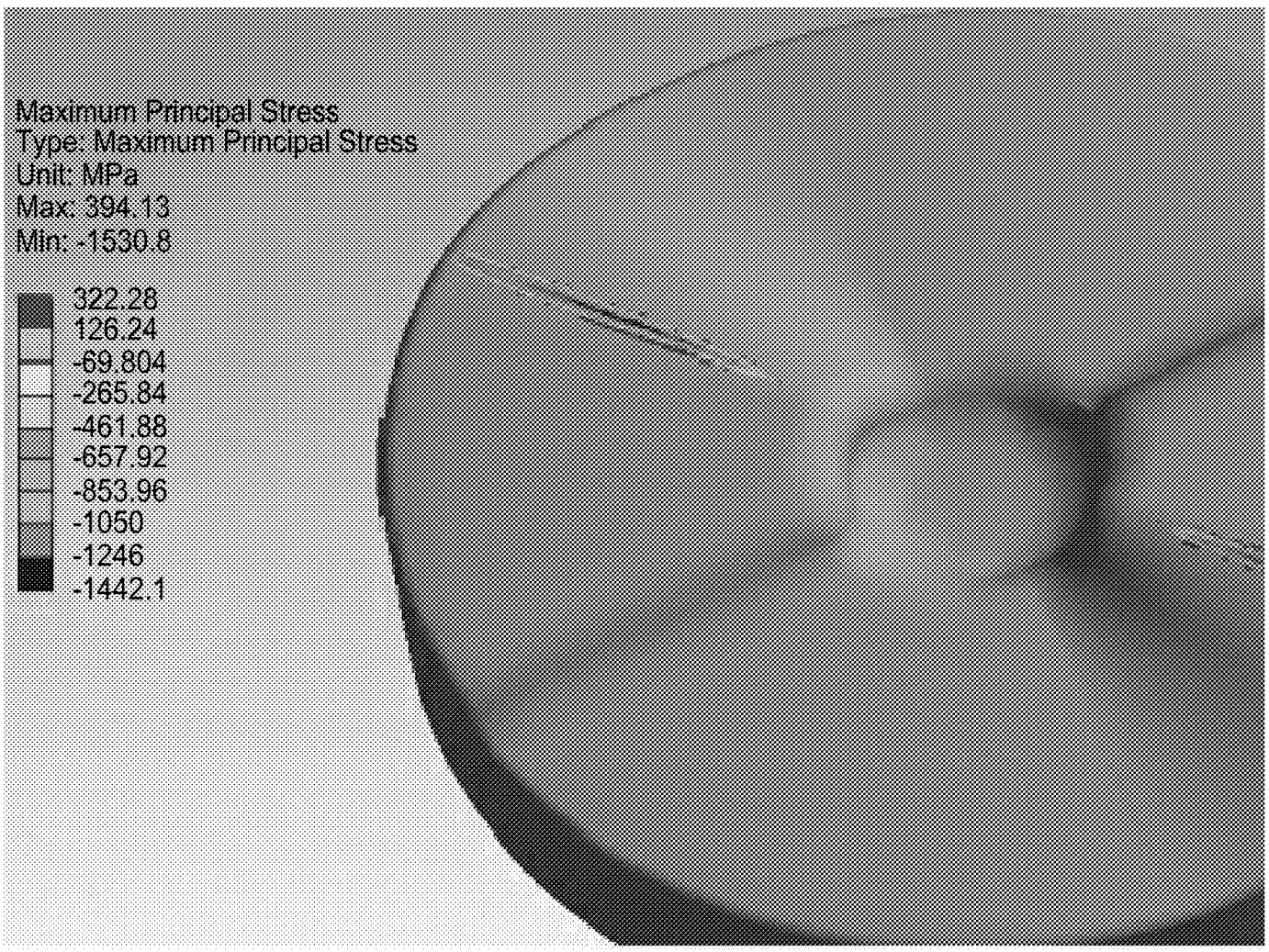

FIG. 40A is an illustration of contact stresses in a flat ramped helical surface of a lost motion assembly piston. FIG. 40B is an illustration of contact stresses in a curved ramped helical surface of a lost motion assembly piston with the contact area biased toward the larger radii of the helix.

Figures 41A, 41B:
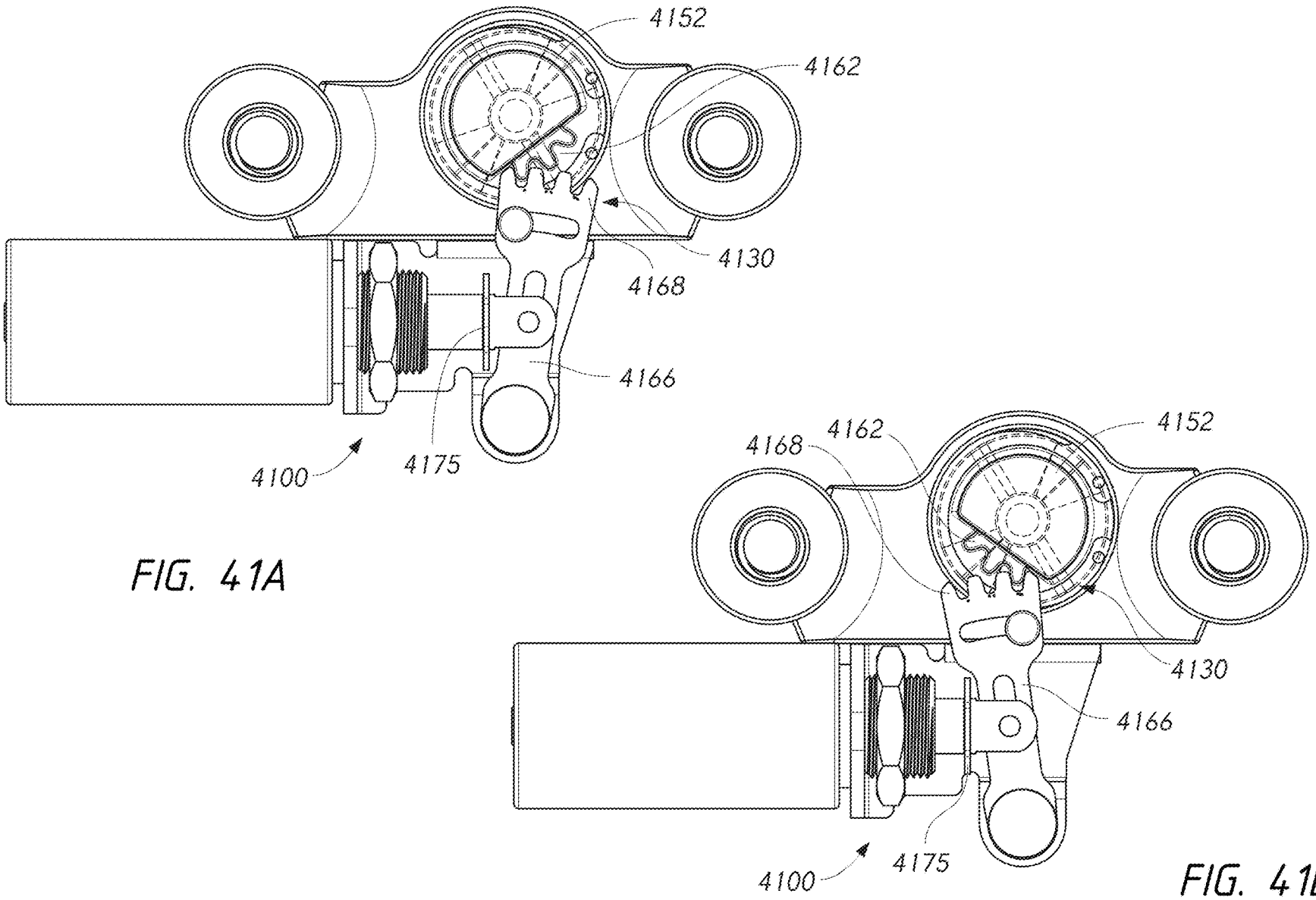

FIGS. 41A and 41B are top views showing a gear actuation assembly for a lost motion piston in "off" and "on" positions, respectively.

DETAILED DESCRIPTION

Figure 1:
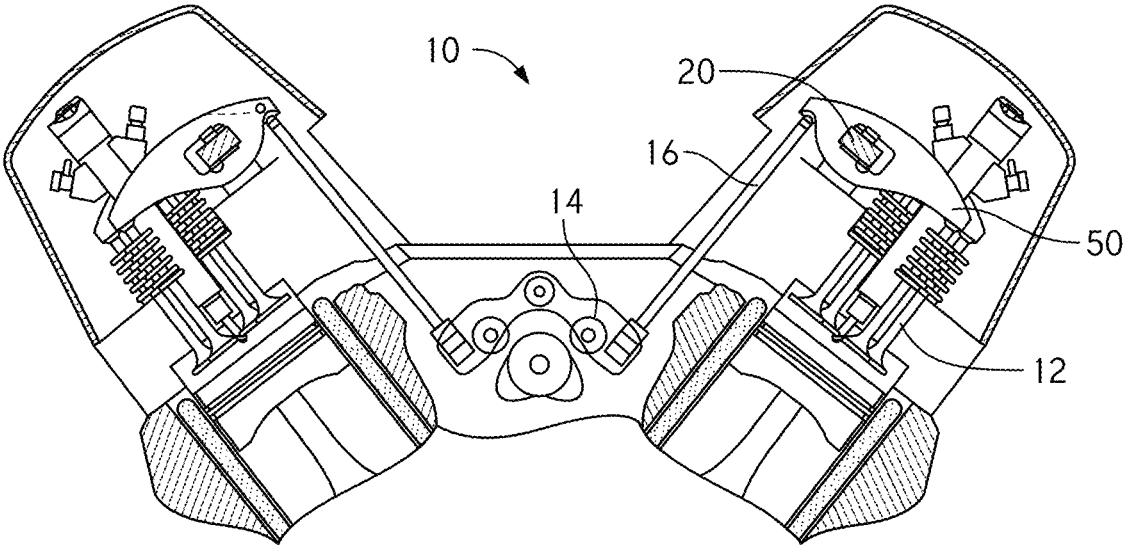
FIG. 1 (Prior Art)
FIG. 1 is a cross sectional view of components of an internal combustion engine environment suitable for implementing aspects of the disclosure.

FIG. 1 illustrates an internal combustion engine environment 10, such as that described in U.S. Pat. No. 7,458,350, which is suitable for background purposes and application of aspects of the disclosure. This may be a V-8 engine having overhead valves 12, which are actuated by rocker arms 50, each of which pivots on a center ball pivot 20. Cam followers 14, which may be rocker or tappet type followers, may drive one or more pushrods 16, which in turn transfer motion to rocker arms 50. Motion from each cam lobe may drive a respective follower 14. Each follower 14 may be linked to and drive two rocker arms 50 of the same type (intake or exhaust), and transfer motion thereto through respective independent lash adjusters. While this engine architecture is suitable for application of the lost motion assemblies and related features described in this application, those skilled in the art will appreciate that other engine architectures may be equally employed. Moreover, the lost motion features may be applied in the context of compression release, bleeder braking, decompression valve lift events and other aspects of engine operation.

Figure 2:
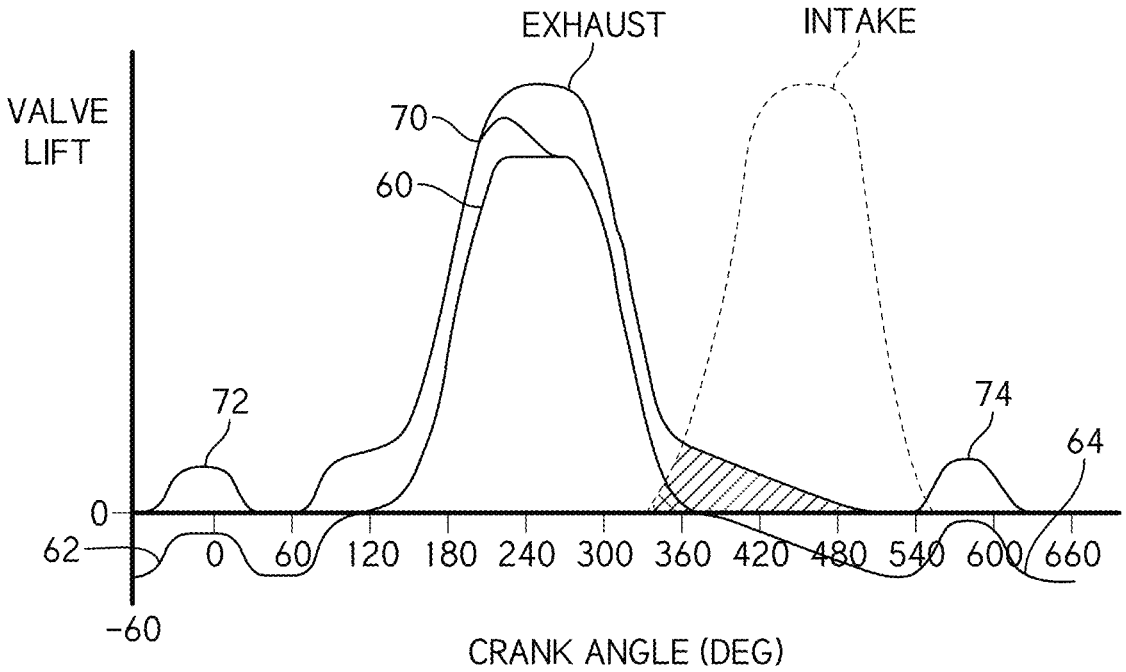
FIG. 2 (Prior Art)
FIG. 2 illustrates curves correlating valve lift and crank angle for main and auxiliary events that may occur during an engine operation.

FIG. 2 illustrates typical engine operational curves, which correlate valve lift and crank angle for main and auxiliary events that may occur during an engine operation. Such operations are described in U.S. Pat. No. 7,905,208, the teachings of which are incorporated herein by this reference. A normal main event valve motion is represented in curve 60, the lower of the two exhaust event curves (first lift event). During positive power, lift is provided to the valves for the intake and exhaust cycles. During main event operation, lost motion components in the valve train absorb motion such that motion in the valve train that would otherwise cause valve lift at compression release event 62 and brake gas recirculation event 64 does not result in valve lift. During auxiliary events, which may occur as represented by curve 70, the lost motion components do not absorb motion in the valve train such that compression release event 72 and brake gas recirculation event 74 result in valve lift at the appropriate time in the engine cycle to effectuate these events.

Figure 3:
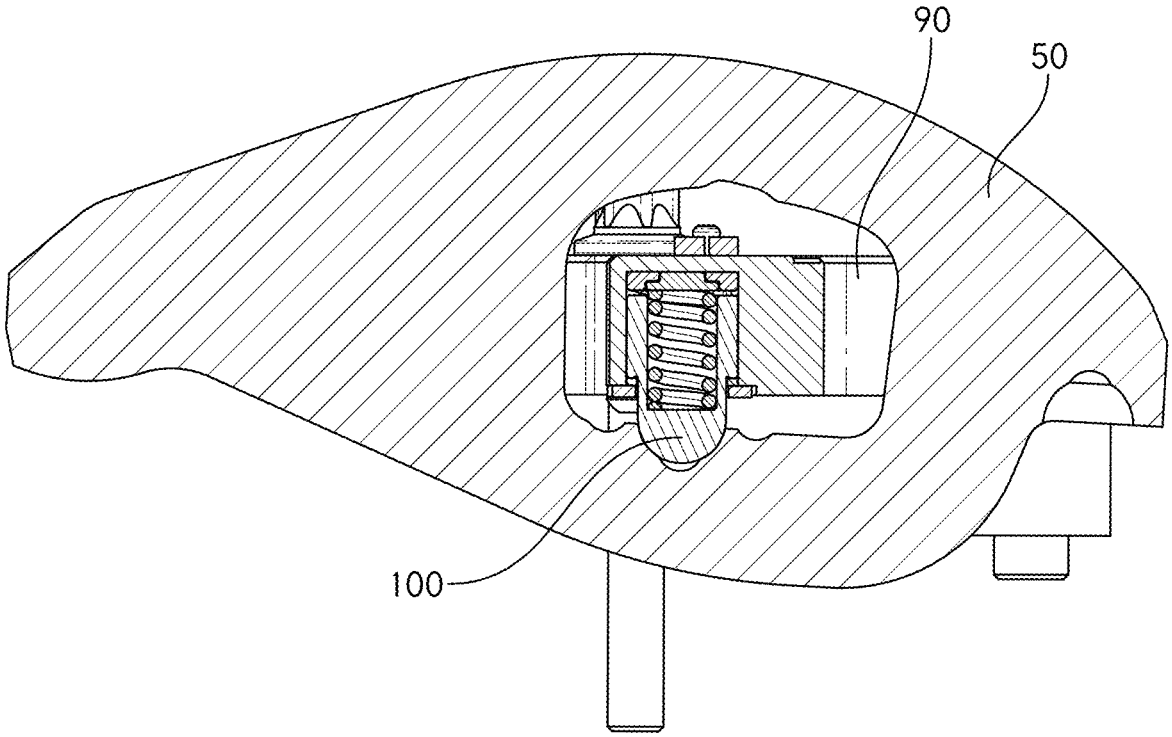
FIG. 3 is a partial cross section showing an example lost motion assembly integrated into a center pivot for a rocker arm.

FIG. 3 illustrates a partial cross-section of a variable-length assembly 100 used as a lost motion assembly, which may be integrated into a housing, such as a rocker arm pivot for rocker arm 50, which may be mounted on a pedestal 90 mounted on the cylinder head. As used herein, a housing may comprise a fixed housing or a dynamic housing. As used herein, a component is "fixed" to the extent that it is essentially (i.e., within design parameters and tolerances) immobile relative to valve actuation motions provided by a valve actuation motion source. In contrast, as used herein, a component is "dynamic" to the extent that it is capable of movement driven at least in part by valve actuation motions provided by a valve actuation motion source. As described in various embodiments described below, the housing, when fixed, may be embodied in components such as an engine rocker arm pivot, bleeder brake housing, valve overhead fixture or an engine support structure, or a bracket or fixture mounted thereon, or, when dynamic, the housing may be embodied in any of a number of valve train components including a rocker arm, valve bridge, pushrod or cam follower. The lost motion assembly 100 may be controlled by an actuating linkage, as will be described, to provide lost motion to the rocker arm pivot, and thus to the valve train, on demand. As will be described, the assembly may be actuated to an "off" position or state (also termed a deactivated or lost motion state) and an "on" state (also termed an activated or full motion transfer state). In the deactivated state (curve 60 of FIG. 2), the assembly may undergo a specific deformation before becoming solid and transmitting main event motion, thus absorbing auxiliary event motion and only transmitting main event motion. In the activated state (curve 70 of FIG. 2), the lost motion assembly is in a rigid state and therefore transmits all camshaft motion to the corresponding engine valve(s).

Figure 4:
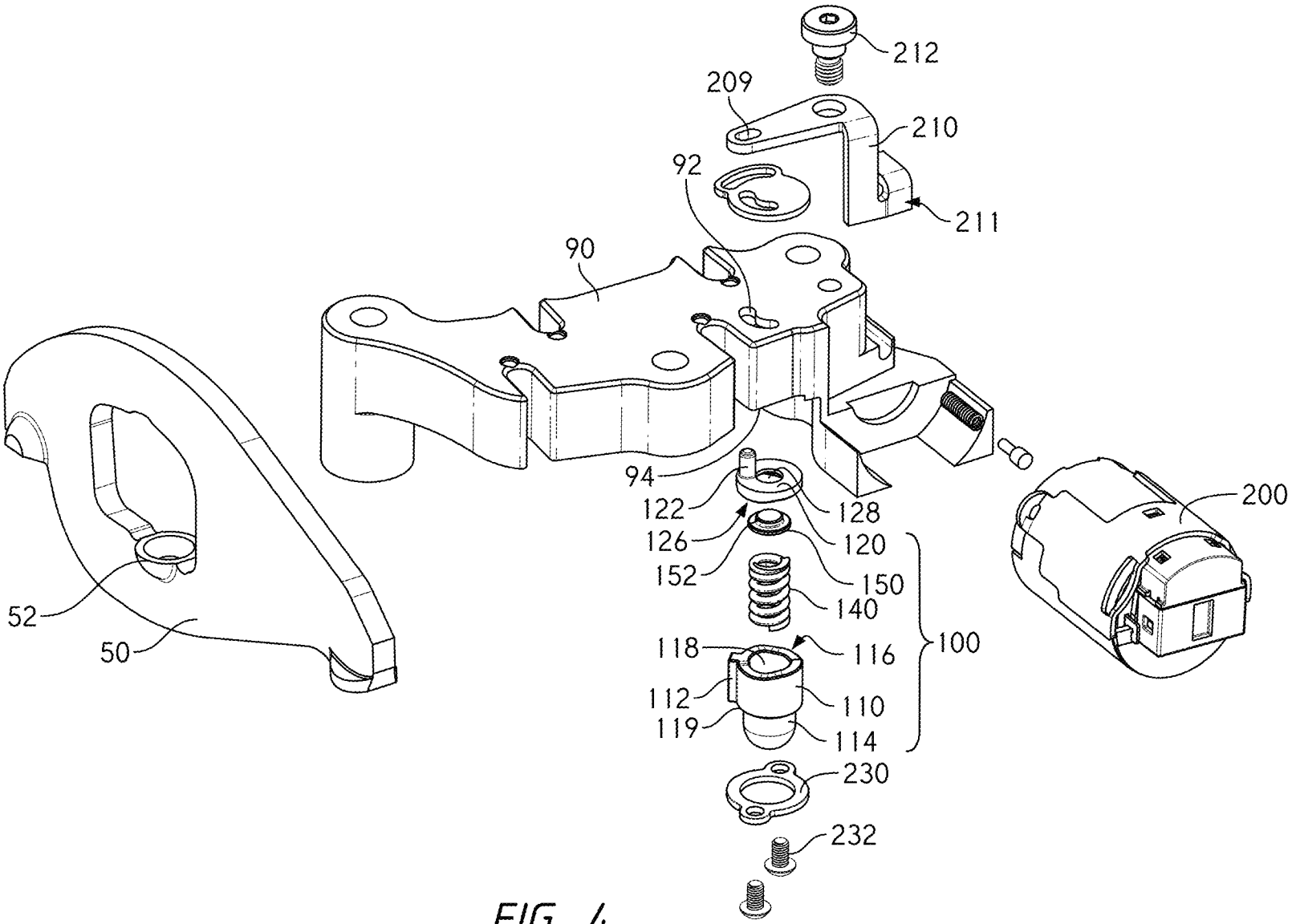
FIG. 4 is an exploded view of the lost motion assembly of FIG. 3 as well as mounting and actuation details.

FIG. 4 is an exploded perspective of an example lost motion assembly 100 as well as other components for mounting and actuating the same. Pedestal 90 may include a number of stations for mounting a like number of rocker arm pivots and rocker arms. Only one pivot and rocker arm are shown for simplicity.

Referring additionally to FIGS. 5A and 5B, lost motion assembly 100 may include a piston or base 110, which may be generally cylindrical in shape and may include one or more anti-rotation elements or keys 112 formed in, or fastened to, a side thereof. A rounded pivot surface 114 is provided on a lower portion of piston 110. An internal recess or bore 118 receives a spring 140. A piston working surface 116 is provided on the base 110 to interact with an actuator plate working surface 126 on an actuator plate 120, which includes an actuation post 122 extending therefrom. These elements and their interaction will be further detailed herein.

The lost motion assembly 100 may be assembled and installed in a retaining assembly which may include a pedestal 90 and other mounting components in the following manner. The spring 140 is installed in recess 118 and a spring cap 150 is installed on the top of spring 140. Actuator plate 120 is then installed on spring cap 150 for rotational movement with a circular extension 152 fitting in a corresponding circular recess 128 in actuating plate 120. These assembled components are then installed in a bore 94 in pedestal 90, which is shaped to receive the major outer diameter of base 110 as well as the anti-rotation element 112. Actuation post 122 may extend through a slot 92 in the pedestal 90. A retaining ring or plate 230 may engage a shoulder 119 formed on the piston 110 and held in place on the pedestal 90 with fasteners 232 thereby retaining the piston 110 and thus the lost motion assembly 100 in position on the pedestal 90.

Figure 7:
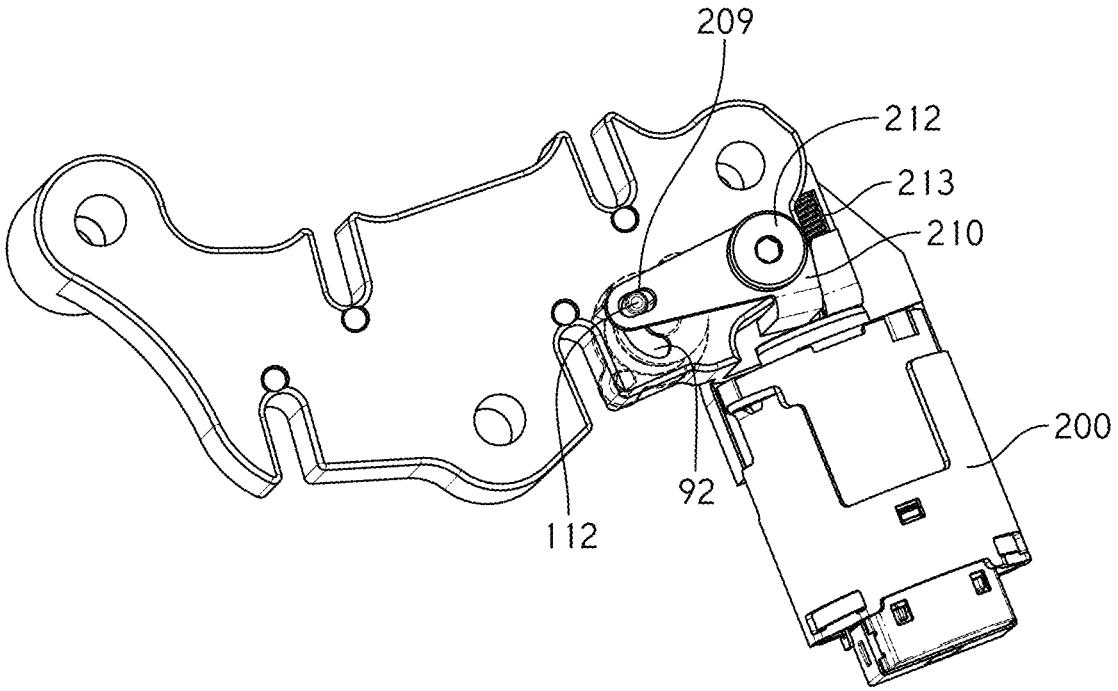
FIG. 7 is a top view of the lost motion assembly of FIG. 4 showing an actuating linkage and solenoid.

Referring additionally to FIG. 7, the lost motion assembly 100 may be actuated with a solenoid 200, which is mounted on the pedestal 90. An actuating arm 210 may be pivotably mounted on the pedestal 90 with a fastener 212. Solenoid 200 includes a plunger that may selectively engage and apply a force to a surface 211 on the actuating arm 210, thereby rotating the actuating arm 210. A return spring 213 provides a biasing force against the plunger action. An aperture 209 in the actuating arm receives the actuating post 122 such that pivoting movement of the actuating arm 210 results in rotational movement of actuating plate 120 and operation of the lost motion assembly 100.

Figure 6A:
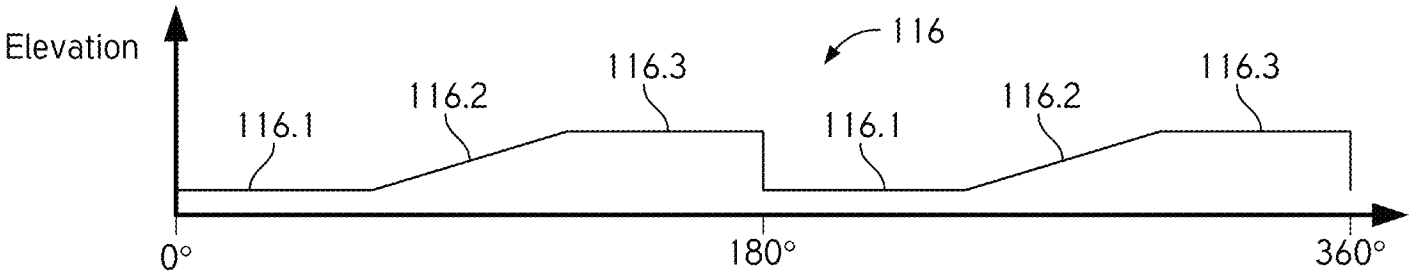
FIGS. 6A and 6B are graphical representations of the working surface profiles of the actuator piston and actuator plate of FIGS. 5A and 5B, respectively.
Figure 6B:
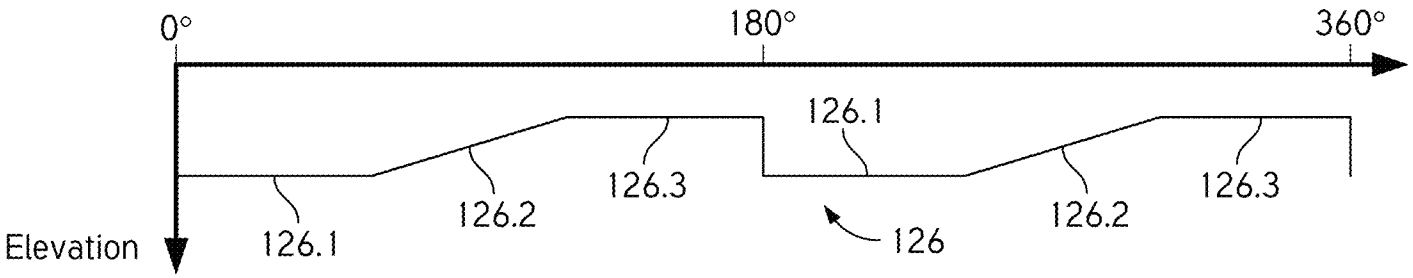

FIGS. 6A and 6B are graphical representations (not to scale) of an example piston working surface 116 and actuating plate working surface 126, respectively. It will be understood that the horizontal axis in these graphs is an angle measured from a reference point around the center of the piston or actuating plate. Complementary upper and lower stepped portions are provided with ramped transitions therebetween. More specifically, piston working surface 116 may include two lower plateaus or flat portions 116.1, two ramped transition portions 116.2 and two upper plateaus or flat portions 116.3. Similarly, actuating plate working surface 126 may include two upper plateaus or flat portions 126.1, two ramped transition portions 126.2 and two lower plateaus or flat portions 126.3. As shown in FIGS. 6A and 6B, the piston 110 and actuating plate 120 are positioned relative to one another (i.e., rotationally positioned) in accordance with a motion-absorbing state in which the two lower flat portions 116.1 of the piston working surface 116 are aligned with the complementary upper flat portions 126.1 of the actuating plate working surface 126. In this state, further described below, the piston working surface 116 and actuating plate working surface 126 may have a gap between them, as they are normally biased away from each other by spring 140 (i.e., there is lash space provided between the working surfaces 116, 126) but are otherwise free to come into contact with each other when forces in the valve train are sufficient to overcome the biasing force, thereby allowing the lost motion assembly 100 to "lose" motion. The extent of this lash space may be referred to as the stroke of the lost motion assembly. When the actuating plate 120 is rotated relative to the piston, thereby placing the piston 110 and actuating plate 120 in a motion transferring state, the profile represented in graph of FIG. 6B shifts relative to the graph of FIG. 6A and the working surfaces 116 and 126 interact such that the clearance between them is reduced. Specifically, the rotation of the actuating plate 120 aligns the upper flat portions 126.1 of the actuating plate working surface 126 with the upper flat portions 116.3 of the piston working surface 116. In this state, engagement between the upper flat portions 126.1 of the actuating plate working surface 126 and the upper flat portions 116.3 of the piston working surface 116 prevent relative axial movement between piston 100 and actuating plate 120, effectively preventing any motion applied to the piston 100 from being lost. The ramped transitions provide for motion similar to screw threads to assist in smooth operation between the two operating states and facilitate minimal wear. As will be recognized, the ramp angle and other parameters of the example components described may be varied to keep operational contact stresses, even during instances of partial engagement, within acceptable limits. For example, to achieve higher lift, a steeper ramp angle and/or increase in angle of relative rotation between the piston and actuating plate may be utilized. For an actuating plate and piston configuration with two ramped transitions, a relative rotation of about 70 degrees may be suitable. In addition, piston diameter, or the diameter of the working surface may be increased to keep contact stresses within acceptable limits. As will be further detailed below, especially with respect to FIGS. 34A and 34B and FIG. 37, transitions may be smoothed and blended to eliminate instances of excessive contact stress even when partial contact between the working surfaces occurs.

Figure 6C:
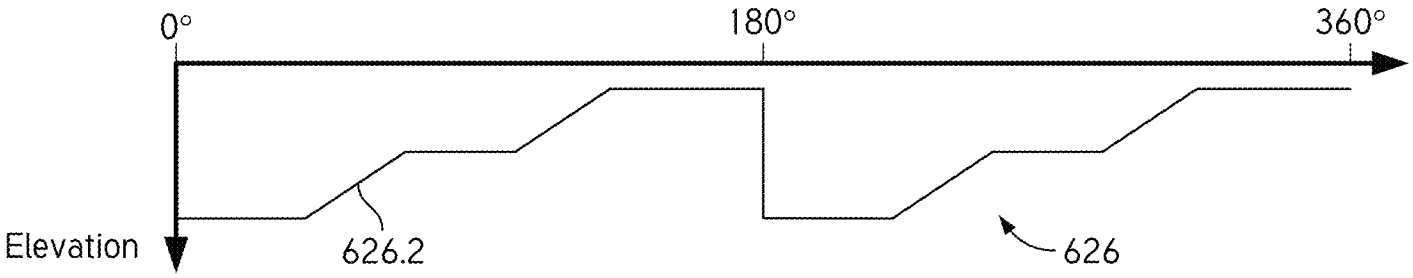
FIGS. 6C and 6D are graphical representations of an alternative embodiment of working surface profiles that may be used with the actuator piston and actuator plate of FIGS. 5A and 5B, respectively.
Figure 6D:
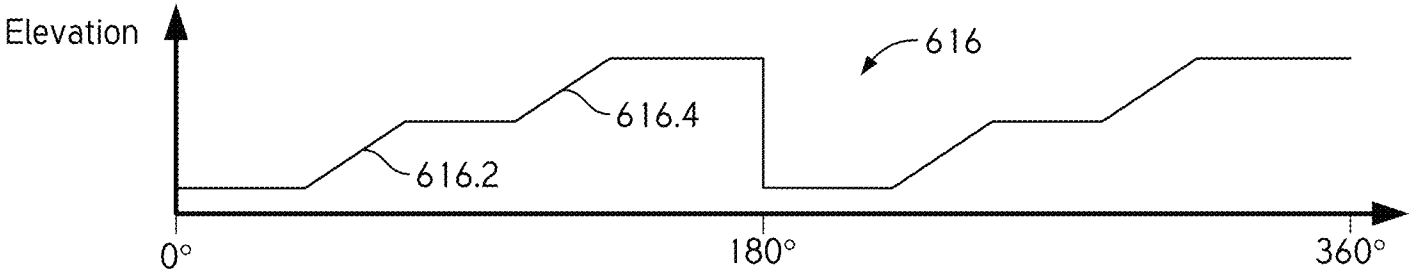

Additionally, while the working surface profiles illustrated in FIGS. 6A and 6B illustrate pairs of upper 116.3, 126.3 and lower 116.1, 126.1 flat portions that are spaced 180 degrees from each other, it is appreciated that a greater or lesser number of upper/lower pairs of flat portions may be provided on the piston 110 and actuating plate 120. For example, both the piston 110 and actuating plate 120 could each comprise four pairs of upper/lower flat surfaces (once again separated by ramp portions) such that each pair spans 90 degrees of the overall profile. Furthermore, FIGS. 6A and 6B illustrate a single height difference between upper and lower flat portions. However, it is understood that flat portions of multiple heights could be provided such that different or intermediate levels of lost motion assembly operating length can be provided (i.e., an operating state in which the lost motion assembly has an intermediate "solid" operating length that is less than its maximum "solid" length). Such an example of working surfaces 616 and 626 are shown in FIGS. 6C and 6D. As will be recognized, with the working surface profiles illustrated, the lost motion assembly may assume a first operating state having a first stroke with the working surfaces aligned as shown, wherein ramped surface 626.2 is aligned with ramped surface 616.2 and the first stroke is defined as the travel surfaces may move before being in contact. A second operating state results with the actuating plate working surface shifted to the right from the position shown in FIG. 6C, where the ramped surface 626.2 is in alignment with the ramped surface 616.4 and a second stroke is defined for the lost motion assembly.

Figure 8A:
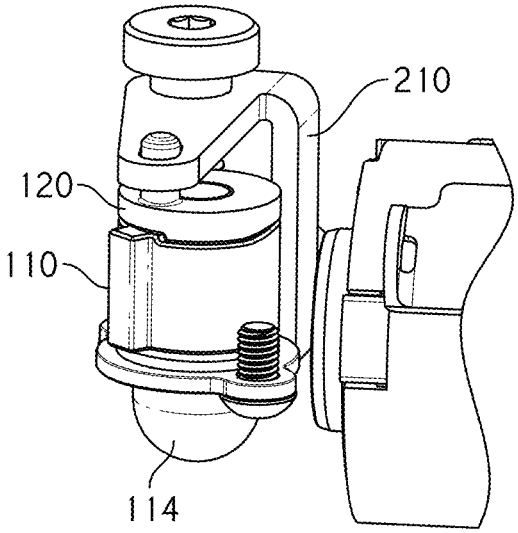
Figure 8B:
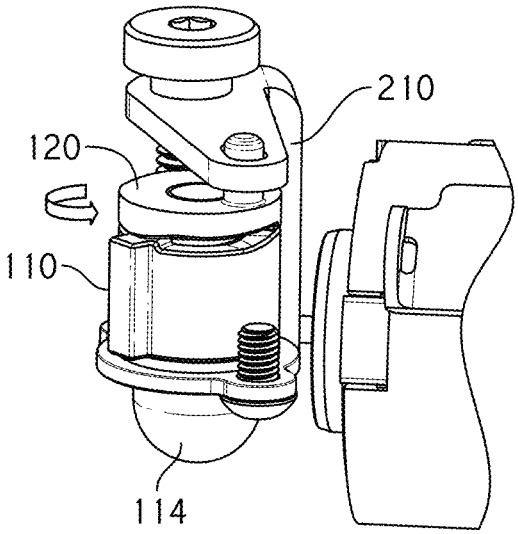

Referring additionally to FIGS. 8A and 8B, in which the pedestal has been omitted, in an "off" or deactivated position shown in FIG. 8A, the flat portions 126.1 (FIG. 6B) are aligned with flat portions 116.1 (FIG. 6A) of the piston working surface such that the lost motion assembly 100 can absorb motion as spring 140 compresses up to the point where flat portions 126.1 engage flat portions 116.1. When the lost motion assembly 100 is actuated in the direction of the arrow in FIG. 8B to a fully "on" or actuated position, the flat portions 126.1 of the actuating plate working surface 126 are fully engaged with the flat portions 116.3 of the piston working surface 116 such that the lost motion assembly 100 is rigid and will not absorb motion.

FIGS. 9A, 9B and 9C illustrate operational positions of the example lost motion assembly. FIG. 9A corresponds to an "off" position or state of the lost motion assembly where the position of the piston 110 corresponds to a base circle or lowest point of the corresponding cam. In this state, the lost motion assembly 100 has a stroke length "S" where it can absorb motion as the inner spring compresses. FIG. 9B shows the lost motion assembly in an "off" state where there is peak lost motion, that is, all of the motion intended to be lost is lost and normal valve lift would begin if further motion is imparted from valve train components that interact with the lost motion assembly. FIG. 9C shows the lost motion assembly in an "on" state where the position of the piston corresponds to the cam base circle. As will be understood by those of ordinary skill, rotation of the actuation plate thus results in lash take-up with the piston on base circle.

FIGS. 10A, 10B, 11A and 11B illustrate an alternative embodiment for a lost motion assembly. In this embodiment, the working surfaces 516 and 526 are provided with shallow ramp portions. This configuration may be useful where the friction between the parts is sufficient to prevent the load on the piston 110 from inducing rotation of the actuating plate. That is, the rotary force induced by the contact angle is less than the static friction provided by the tangent force and the coefficient of friction. With this configuration, flat surfaces may be unnecessary. Moreover, the stroke of the lost motion assembly may be controlled by appropriate selection of the ramp angle and the degree of rotation of the actuating plate (i.e., solenoid plunger and/or actuating arm travel). FIGS. 11A and 11B depict the working surface geometries in detail (not to scale). The angle of the working surfaces may be on the order of 3 degrees and may be determined based on loading and friction against relative rotation. For example, for steel on steel and a lubricated frictional coefficient of 0.1, a 5.7 degree angle may be at approximate equilibrium. With a shallow 3 degree angle, for example, the frictional forces are approximately 90% more than the rotational force tending to counter-rotate the actuation plate 120. When load is applied the actuator will remain at the angular position at the time of loading. For stroke control the extent or degree of rotation can be managed. The stroke per turn can also be increased if the angle is maintained the same, however a larger diameter piston may be used to increase the perimeter in the calculation. As will be recognized, such gentle inclined or shallow ramp surfaces do not have abrupt transitions and do not require transition from a ramped slope to a flat portion. As such, the potential for partial engagement of bearing surfaces and increased contact stress may be reduced. As will also be recognized, the ramps maintain flat-on-flat contact as relative rotation occurs. FIGS. 12A and 12B illustrate operational positions corresponding to lost motion "off" and lost motion "on," respectively. As can be seen, no abrupt transitions are encountered as the actuating plate rotates relative to the piston. FIG. 13 depicts the contact area, which is essentially flat-on-flat contact of two segments of a circular ring. As will be recognized by those of ordinary skill in the art, the diameter and width of the contact areas, as well as the length of contact areas may be varied to ensure that contact stresses do not become excessive during operation.

FIGS. 14A, 14B, 14C and 14D depict operational states of a lost motion assembly with ramped slopes on the piston working surface and actuating plate working surface. These figures correspond to actuator plate rotations of 0, 30, 80, and 100 degrees, respectively. As can be seen, the interaction of the working surfaces can provide variable position/stroke of the actuator. The gentle sloped ramp of the actuator allows the piston to rotate easily when unloaded and locks the piston in place via friction when the loading is applied. Actuation can be varied by using a rotary or linear stepper motor or any type of variable position or variable force actuator methods to provide multiple positions of operation. The force required to move and hold the sloped ramp actuator in position is very low due to the low angle slope design, and bias spring that unloads the mechanism in the base circle position of the cam profile.

According to another aspect, lost motion assemblies may be configured to operate in systems equipped with lash adjusters. Lash is excessive play in the valve train—the linkage from the cam to the valve, including, for example, pushrod to rocker or pushrod to cam follower interfaces. Lash can lead to excessive noise, impact loading and other problems. A lost motion assembly is designed to have stroke to absorb unwanted events during "normal" main event motion. Likewise, a system with lash adjusters in the camshaft follower (or elsewhere in the system) is also designed to take up slack in the valvetrain. Thus, it is important that a lost motion device's stroke does not deplete under the forces introduced into the valve train by lash adjusters. The spring force in the lost motion assembly must be sufficient to maintain the assembly's stroke when a lash adjuster operates to take up slack in the valvetrain while ensuring that the lost motion assembly is only compressed as a result of camshaft motion. Thus, the lash adjuster will typically take the slack out of the system and the stroke of the lost motion assembly needs to be closely controlled to track the lost motion events in the camshaft. The "brake" or lost motion lash does not need to be set. Rather, only the stroke of the system needs to be set.

FIGS. 15A, 15B and 15C depict operational states of a lost motion assembly 100 that may be used in valve actuation systems that include lash adjusters. FIG. 15A shows a lost motion assembly in an "off" state with the piston position corresponding to the cam base circle. The stroke "S" of the piston 110 corresponds to the distance between the working surfaces of the actuating plate 120 and the piston 110. The stroke in this case is equal to the lost motion lift plus a small clearance to allow rotation of the actuating plate 120. This clearance may be on the order of +/−0.001 inches and may be controlled with the use of a shim 235 situated between the piston shoulder 119 and the retaining plate 230. Thus, shim thickness (which can be very accurately determined) may be used to control the clearance between the actuating plate and the piston 110. Moreover, as will be recognized, the shim may be used to set the stroke "S" of the lost motion assembly and lash in the valve system does not need to be set due to the presence of the lash adjusters in the valve train. The lost motion assembly spring 140 exerts sufficient biasing force that it will not be compressed when the lash adjusters in the valve train operate to take up lash. FIG. 15B shows the lost motion assembly in an "off" state with the position of the piston 110 corresponding to peak compression release lift, for example. This is the point where the lost motion assembly goes "solid" and positive power lift is provided. The lift "L" is thus lost during the transition between the piston shoulder 119 lifting from the shim 235 to the point where the piston 110 makes solid contact with the actuating plate 120. FIG. 15C shows the lost motion assembly in an "on" position and the piston position corresponding to cam base circle. It will be understood that the small clearance remaining at this point between the actuation plate 120 and the piston 110 allows relatively easy rotation of the actuation plate 120. Moreover, the actuation plate at this stage does not sustain significant load, and is essentially unloaded since the lost motion assembly spring 140 exerts forces to counter those in the valve train caused by the lash adjusters and also keeps the spring cap 150 essentially bottomed against the floor (ceiling) 98 of the pedestal bore 94. Thus, actuation of the actuation plate 120 in this state requires very little force and can be implemented without undue wear on the lost motion assembly components, even with frequent operation. The availability of low force actuation also provides quick system response times when actuation commands are initiated to the solenoid or other actuation devices, which may include progressive actuating devices such as stepper motors, variable position actuators and variable force actuators.

FIGS. 16A and 16B illustrate details of a two-position on/off actuation system. Rotational movement of the actuating plate 120 can be limited by providing a slot 92 in the pedestal which defines the angular on and off positions for the actuating plate post 122. The slot may be machined into the pedestal (see also FIG. 1). FIG. 16A illustrates an off position 210' of the actuating arm as well as an on position 210" of the actuating arm and the corresponding position of actuating post 122 of the actuating plate 120 as moved by solenoid 200. Slot 92 can be modified to achieve different applications and stroke lengths of the lost motion assembly. FIG. 17 illustrates a further modification of mounting details in which a timing plate 290 may be adjustably secured to the pedestal 90 with a fastener 292 in a first slot 294 which permits rotational adjustment of the plate 290 and thus adjustment of a second slot 296 which adjusts the travel extent of actuating plate post 122. This implementation may be used to adjust the lash and angular travel of the actuator piston.

FIG. 18 illustrates another embodiment of a lost motion assembly 1100 which utilizes two sets of interacting working surfaces to achieve increased effective travel and stroke for a given angular relative rotation. A center actuating plate 1120 may include two working surfaces 1126.1 and 1126.2, each of which interact with a working surface on a respective piston 1110.1 and 1110.2. Rotational movement of the center actuating plate may be achieved with a radially extending post (not shown) or other extension that may engage an actuating assembly. The pistons 1110.1 and 1110.2 are mounted to remain rotationally stationary in a retaining assembly. A biasing element 1140 may extend within the components and bias them in a separated configuration. FIG. 19A illustrates an "off" position in which the assembly is in a base circle position with the assembly expanded to its maximum stroke. FIG. 19B illustrates an "off" position when the full stroke of the assembly is absorbed. FIG. 19C illustrates an "on" position in which the lost motion assembly is in a solid, incompressible state and thereby transmits full cam motion. As will be recognized, this configuration permits increased lost motion assembly stroke for a given degree of rotation of the actuating plate 1120.

FIG. 20 illustrates an alternative mounting and anti-rotation configuration for a lost motion assembly piston, such as that shown in FIG. 1. Piston 110 may include an anti-rotation recess 112' which receives a complementarily shaped tab or projection 238 on retaining ring 230, which may be fastened to the pedestal 90 in a manner similar to the retaining ring 230 shown in FIG. 1. As will be recognized by those of ordinary skill in the art, various mounting configurations may be implemented for the components of the lost motion assemblies described herein.

According to aspects of the disclosure, variable length piston assemblies functioning as lost motion assemblies may be integrated into valve rocker arms. Referring to FIGS. 21 and 22, a rocker arm 2150 may include a roller element 2152 secured within journals 2154 by a pin or axle 2156. Roller element 2152 engages a cam surface (not shown) to affect movement of valve elements (not shown) as is known. A rocker arm shaft journal 2158 receives a rocker arm shaft (not shown) which supports the rocker arm for pivoting movement on an engine. Rocker arm 2150 may include a lost motion piston assembly receptacle or bore 2180 for receiving the components of a variable-length assembly/lost motion assembly 2100 therein. Such components may include a lost motion actuator piston 2110, biasing spring 2140, spring cap 2145 and actuating plate 2120 assembled into the lost motion piston assembly bore 2180 and retained therein by a fastener 2170. Fastener 2170 may engage a slot 2112 in the lost motion actuator piston 2110 to prevent rotation but permit limited axial movement thereof. Lost motion actuator piston 2110 and actuating plate 2120 are provided with respective working surfaces that interact to provide selective axial movement in a manner described above relative to the other embodiments. An actuating pin 2122 extends from the actuating plate 2120 an engages an actuator linkage 2124. Actuating plate 2120 may rotate relative to the lost motion actuator piston 2110 under force from the actuator linkage 2124, which is given motive force by actuating components secured within actuator receptacle 2190. An actuator plate limiter 2126 may be secured to the rocker arm 2150 and may limit movement of the actuating plate pin 2122 and thus the movement of the actuating plate 2120. Actuating plate limiter 2126 may also adjust the rotational position of the actuating plate and thereby set the lash for the lost motion assembly 2100 as will be described.

The actuating components within actuator receptacle 2190 may include an activation piston 2192, an activation piston biasing element 2194, a biasing element end plate 2196 and a retaining element 2198, which may be a spring retainer or "C" clip that expands within a slot in the bore 2190 to retain the elements therein. Referring additionally to FIGS. 23A and 23C, activation piston 2192 may be actuated hydraulically via an oil passage 2310 which provides hydraulic fluid to a chamber 2312 defined by the activation piston 2192 and receptacle 2190. Oil may be provided selectively from the rocker shaft using ports in a known manner. Biasing element 2194 tends to counteract the hydraulic forces on the activation piston 2192 and return the activation piston 2192 to its "off" position (to the left in FIGS. 23A and 23C). Activation piston 2192 may be secured to the linkage 2124 with a pin 2125 extending from activation piston 2192 through an elongated opening formed in the upper side wall of the receptacle 2190. Linkage 2124 pivots about a linkage pivot pin 2127. In operation, the actuating assembly will be in an "off" state shown in FIG. 23A in the absence of sufficient hydraulic fluid and pressure in the chamber 2312. Activation piston 2192 is retracted (to the left in FIG. 23A) and actuating plate pin 2122 is in the position shown. As shown in FIG. 23B, this "off" state corresponds to a shortened length of the stacked actuating plate 2120 and piston 2110. When hydraulic fluid flows into chamber 2312, piston 2192 moves to the position shown in FIG. 23C, thus moving actuating plate pin 2122 to the position shown and causing the stacked actuating plate 2120 to rotate relative to the piston 2110 and an increase in the effective length of the stacked actuating plate and piston 2110.

FIG. 24 shows further details of the limiter 2126, which may be rotatably secured to the rocker arm by a central pivot 2408 and may include an adjustment slot 2410 for receiving an adjustment fastener 2412. An actuating pin receiving slot 2414 receives and limits movement of the actuating plate pin 2122. Thus, rotational adjustment of the limiter 2126 may be used to limit the travel of the actuating plate pin 2122 and thus the extension undergone by the lost motion assembly 2100. In addition, lash may be set using the limiter 2126. The fasteners 2412 and 2408 may be loosened and the rack may be moved to the "on" position manually. Then the limiter 2126 may be rotated to a position in which the actuating plate pin 2122 is engaged by the end of slot 2414. This effectively reduces the extension of the piston beyond a point where any undue lash would exist. As will be recognized, the stroke of the assembly is fixed by the geometry of the slot 2414. Rotation of the limiter 2126 may thus adjust the "off" position stop (the rightmost extent of slot 2414). Rotation of the limiter 2126 in a counterclockwise direction, for example, will move the "off" position stop counterclockwise and the piston will ride up the ramp and be partially extended when the assembly is in the "off" state.

According to aspects of the disclosure, variable length piston assemblies may be used in applications other than lost motion applications. For example, such variable length piston assemblies may be utilized in bleeder brake applications. As will be recognized in the art, bleeder brake components provide for the slight lifting of engine valves at appropriate times during the engine cycle to effect braking action. FIGS. 25 and 26 illustrate an exploded and assembled view, respectively, of an example bleeder brake housing, which includes an integrated variable length piston assembly and actuator assembly. A bleeder brake housing 2510 may be fastened to an engine, e.g., above an exhaust valve or valve train component, using housing fasteners 2512 that extend through fastening bores 2514. Bleeder brake housing may include a variable length piston assembly receptacle 2516 for receiving components of the variable length piston assembly 2550. An actuating assembly mounting extension 2571 may include one or more threaded bores 2572 for securing the actuating assembly thereto.

An example variable length piston assembly 2550 may include a piston 2552 with a piston working surface 2554 defined thereon and a fixed plate 2556 with a fixed plate working surface 2558 defined thereon. These respective surfaces interact, in a manner that will be further described, to provide for variation in the length of the piston/fixed plate stack in response to relative rotational movement. An actuating ring 2560 may include an actuating ring pin 2562 extending therefrom. A piston biasing spring 2564 may be disposed on the pin 2562. An adjustment set screw 2569 may abut a rear surface of the fixed plate 2556 and be secured with nut 2567 within the housing 2510 in a threaded bore (hidden in FIG. 25). A snap ring retainer 2561 may secure the variable length piston assembly components within the receptacle 2516. Further details regarding these components and their interaction will be provided below.

An actuating assembly 2570 may be secured to the bleeder brake housing 2510. Assembly 2570 may include a solenoid coil 2572 secured to a mounting bracket 2573 with a threaded fastener 2574 and having a solenoid plunger 2575 disposed for selective axial movement within the coil 2572. A spring element 2576 may bias the solenoid plunger in an extended direction. The end of plunger 2575 may include a yoke that is secured to an aperture 2568 within a linkage 2566 that may be pivoted to cause rotational movement of the piston 2552 as will be explained.

FIGS. 27A and 27B illustrate an example actuation operation. FIG. 27A is a view from the underside of housing 2510 showing the piston 2552 in an "off" position. Solenoid plunger 2575 is in an extended position in which piston 2552 is in a first rotational position indicated by the position of pin 2562 at a "10 o'clock" position as viewed in the figure. When solenoid 2572 is activated, plunger 2575 retracts to the position shown in FIG. 27B, whereby piston 2552 is in a second rotational position indicated by the position of pin 2562 at an "8 o'clock" position as viewed in the figure. This "on" position coincides with the maximum length of the piston and fixed plate stack. FIGS. 41A and 41B illustrate an alternative actuation assembly 4100 which utilizes a gear interface 4130 to the piston 4152, which may be provided with a number of gear teeth 4162, which may be involute elements that result in a constant rotational velocity and force on the piston 4152 when actuated. An actuation arm 4166 may include a number of gear teeth 4168 on an end thereof which engage the piston gear teeth 4162. Under action from the solenoid plunger 4175, actuation arm 4166 may cause rotation of the piston 4152 from the "off" position shown in FIG. 41A to the "on" position shown in FIG. 41B.

FIGS. 28A and 28B illustrate an example anti-rotation mounting configuration for a fixed plate and a piston assembly receptacle in a bleeder brake housing 2510, respectively. The fixed plate 2556 may be provided with one or more notches or recesses 2810 on an outer circumference. Referring additionally to FIG. 28B, the bleeder brake housing 2510 may be provided with a like number of projections 2820 which are received in the recesses 2810 when the fixed plate is installed in position in the housing 2510, thereby preventing rotation of the fixed plate within the housing.

FIG. 29 is a cross-section illustrating installed positions of the components of an example variable-length assembly and adjustment of the assembly using the adjustment set screw 2567. Fixed plate 2556 is disposed in a like-sized bore in the housing 2510 and secured against relative rotational movement as described above, in abutting engagement with the end of adjustment set screw 2569. As will be recognized, the adjustment screw 2567 can be used to adjust the locked height of the fixed plate 2556. For example, downward adjustment of the screw 2569 may result in displacement of the fixed plate 2556 and piston 2552 stacked components by a distance "G" as indicated. Thus, the configuration is advantageous in permitting lash and other adjustments to the variable-length assembly.

FIG. 30 is a perspective of a piston actuating ring 2560 with the piston actuating ring pin 2562 installed therein. FIG. 31 illustrates an alternative mounting configuration for the piston actuating ring 2560. According to this example, the variable-length assembly receptacle 2516 may be provided with a counterbore 3110 which acts as a journal or guide for the actuating ring 2560 to ride within. A snap ring 3112 may be used to secure the actuating ring 2560 within the counterbore 3110. This configuration is advantageous in preventing binding or cocking of the actuating ring 2560 within the receptacle 2516, mitigating side loading effects on the piston 2552 and providing smooth operation of the variable length piston assembly overall.

FIGS. 32 and 33 show further details as to how components of an example variable length piston assembly may be installed in a bleeder brake housing, including features of a piston biasing element. This configuration provides a low-profile piston biasing feature which may be used in applications, such as those with constrained space beneath a valve cover, where space is limited. FIG. 33 shows details of an example piston, which may include an annular base 3310 and a central raised portion 3312 having a lateral pocket or recess 3314 defined on a side thereof. A circular recess 3316 is also formed in the base 3310 for receiving the spring 2564 and permitting clearance of the end of pin 2562. FIG. 32 is a cross-section showing an arrangement of the piston assembly components. Piston 2552 (shown in an inverted position compared to FIG. 33) extends within a bore in the receptacle 2516. The actuating ring 2560 is retained in a bore 3210 for rotational movement and actuating ring pin 2562 extends upward into the circular pocket 3316 and is disposed in the lateral pocket 3314. A snap ring 2561 retains the actuating ring and piston in place. As will be recognized, spring 2564 provides a relatively light upward biasing force on the piston 2552 to prevent contact with valves or valve train components when bleeder braking operation is not being provided.

FIGS. 34A, 34B and 34C show different operational positions of an example variable length piston assembly. In FIG. 34A, the assembly is in an "off" position with the working surfaces of the fixed plate 2556 and piston 2552 in complete complementary engagement such that the effective length of the assembly is minimal. In FIG. 34B, the piston is rotated to an intermediate position such that the flat portions of the working surface are in partial engagement and the effective length of the assembly is at its full extent. In FIG. 34C, the piston is rotated completely, increasing the contact area of the working surfaces and maintaining the effective length at the full extent. As will be recognized, working surface profiles may be provided that convert about 70 degrees of rotation into about 1.5 mm of extension and locking with 50 degrees of rotation generating the full 1.5 mm lift and additional rotation providing increased contact area on the working surfaces.

According to an aspect of the disclosure, working surface profiles are provided on a variable length piston assembly which advantageously reduce the peak contact stresses experienced by the interacting piston and fixed plate. More particularly, the ramped portions of the working surfaces may include a surface that is the form of a variable pitch helix may be utilized. Such surfaces will result in a "cone-on-cone" contact shape between the piston surface and fixed plate surface in instances of partial engagement, i.e., when the piston is in a partially activated position when the piston surface engages the fixed plate surface. This contact shape may be configured to ensure that contact stresses do not become excessive. FIGS. 35 and 36 are perspective views which illustrate details of example helical working surfaces on a piston and fixed plate, respectively. Piston 3510 may include a helical working surface with two ramps 3520.1 and 3520.2 having the form of a variable pitch symmetrical helix. A tangent slope section may be provided in the center. In an example implementation, the lift and pitch of the ramp portions may extend for about 50 degrees of a radial sweep about a central axis of the surface, with flat areas 3530.1 and 3530.2 beyond this rotation. More particularly, from a radial sweep of zero to about 24 degrees, the pitch may progress from zero (flat surface) to a pitch of 21 (tangent slope). At the pitch of 21, there may be a dwell of 1 degree. At further radial sweep positions of 25 to 50 degrees the pitch may progress (regress) from a pitch of 21 to a pitch of 0. Similarly, the fixed plate 3610 may have two ramps 3620.1 and 3620.2 in the form of a variable pitch symmetric helix and extend for about 50 degrees, with flat areas 3630.1 and 3630.2 beyond this rotation.

FIG. 37 schematically illustrates the engagement of the respective ramp portions 3520.1 and 3620.1 of the piston 3510 and fixed plate 3610. FIG. 38 illustrates further detail of a complex helix surface profile with contour lines 3550.1, 3550.2 and 3550.3 showing the curvature of the surface at three different radii from the center. As will be recognized, the pitch and curvature varies at different radii. At any given radius, the helix is an angular sweep of a surface about an axis while also translating axially at a prescribed pitch. In the case of a complex curved ramp the pitch varies as the sweep rotates through the angle. Starting with zero pitch peaking at the midway point through the angle and finally ending with zero pitch the shape is as shown above.

FIGS. 39A-39E are cross-sections of an example lost motion assembly piston with helical ramped portions, taken in respective radial planes as indicated in FIG. 35. The cross-section in FIG. 39A shows the elevation of ramps 3520.1 and 3520.1 just after transition from a lower flat area (proceeding in a counterclockwise direction when viewed from above). One of the elevated flat areas 3530.2 is visible in the background on the right. FIG. 39B shows a slightly higher elevation of the ramps 3520.1 and 3520.2. FIGS. 39C and 39D show still higher elevations of the ramps 3520.1 and 3520.2, with FIG. 39D showing an elevation of ramps

3520.1 and 3520.2 that is almost flush with the flat area 3530.2. FIG. 39E shows a section taken through the flat areas 3530.1 and 3530.2.

In order to further reduce contact stresses, the variable pitch helical surfaces of the ramps 3520.1 and 3520.1 may be provided with a slight curvature (i.e., large radius of curvature) in a radial direction and oriented to provide more contact area at the outer radii of the piston. FIG. 39D is annotated to show a slight curvature of radius "R" of the surface 3520.1 in the radial plane of the cross-section. The curvature radius may be on the order of 300 to 500 mm. Moreover, as indicated, the curvature may be oriented such that the radius origin "O" may be offset from the rotational axis "A" of the piston. This orientation of the curvature may provide a very slightly higher elevation of the surface near the outer radial edge of the piston and thereby bias contact between the piston and the actuating plate such that slightly greater contact forces occur near the outer radial edge of the piston and are thus spread over a greater width area of line contact, reducing contact stresses.

FIGS. 40A and 40B illustrate the advantage of the radial curved surface geometry in reducing contact stress. FIG. 40A shows a contact stress result for a ramp that has a flat cross-sectional profile (i.e., where there is no curvature in the radially extending line 3520.1 representing the surface in any of FIGS. 39A-D). FIG. 40 B shows a contact stress result for a ramp that has a slight curvature in the cross-sectional profile of the ramp surface. As can be seen, the radial curvature of the ramp surface may result in a substantial decrease in contact stress since the curvature causes contact forces to be distributed such that the outer areas (larger radii) of the piston supports higher contact forces, which are distributed over a slightly wider area of line contact than would be the case for inner areas (smaller radii) of the piston.

As will be recognized, the interaction of the variable pitch symmetric helix sections of the respective working surfaces provides cylinder on cylinder line contact between the piston working surface and the fixed plate working surface in the instance where the respective ramp sections of each engage one another, i.e., during surface engagement when the piston is in an intermediate rotational orientation. If an "on" actuation sequence is initiated, in the instance where engagement of the piston and fixed plate occurs when flat areas are not aligned and rather the respective ramp portions engage when the load is applied, contact will be line contact with sufficient breadth that peak contact stresses may be reduced, thus preventing the development of contact stress in excess of material limits. Moreover, in such an event, and when line contact occurs at a place where the slope is greater than 8 degrees, the pitch may permit the piston to rotate under valve train forces back to the off position.

As will be recognized, various manufacturing methods may be used to creating variable length pistons and piston assemblies according to aspects of this disclosure. Such methods may include the steps of cold forming, hot forming, powdered metal forming, casting or conventional machining. Post forming hardening may be employed with one or more of these steps.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. In an internal combustion engine comprising a valve train for actuating one or more engine valves, a variable-length assembly for controlling motion applied to one or more of the engine valves comprising:

a housing;

a piston disposed within the housing and having a piston working surface defined thereon, the piston working surface including at least one piston working surface ramped portion;

an actuating plate cooperatively associated with the piston and having an actuating plate working surface defined thereon, the actuating plate working surface including at least one actuating plate working surface ramped portion for selectively contacting the at least one piston working surface ramped portion;

a retaining assembly for retaining at least one of the actuating plate or the piston in the housing;

an actuating assembly for rotating one of the piston or the actuating plate relative to the housing wherein rotation of the piston or actuating plate causes the variable-length assembly to change length, from a minimum length to a maximum length, to take up clearance in the valvetrain, and wherein the piston working surface and the actuating plate working surface are arranged to remain in contact with one another throughout the change in length of the variable-length assembly from the minimum length to the maximum length.

2. The variable-length assembly of claim 1, wherein the housing is a fixed housing.

3. The variable-length assembly of claim 2, wherein the housing is a bleeder brake housing.

4. The variable-length assembly of claim 1, wherein the housing is a dynamic housing.

5. The variable-length assembly of claim 4, wherein the piston working surface and actuating plate working surface ramped portions extend at an angle of less than 5 degrees.

6. The variable-length assembly of claim 4, wherein the housing is a rocker arm.

7. The variable-length assembly of claim 6, wherein the actuating assembly is integrated into the rocker arm.

8. The variable-length assembly of claim 1, further comprising a biasing element cooperatively associated with the piston and the actuating plate to provide a biasing force.

9. The variable-length assembly of claim 8, wherein at least one of the actuating plate and the piston is mounted for rotational movement relative to the biasing element.

10. The variable-length assembly of claim 1, wherein the piston working surface and the actuating plate working surface each include at least one lower flat surface and one upper flat surface, the at least one respective ramped portion on each extending between the at least one lower flat surface and the at least one upper flat surface.

11. The variable-length assembly of claim 1, wherein the piston working surface and actuating plate working surface ramped portions each extend continuously without intervening interruption.

12. The variable-length assembly of claim 1, wherein the piston working surface and actuating plate working surface ramped portions each include a variable pitch helix surface.

13. The variable-length assembly of claim 1, wherein the valve train includes a rocker arm and wherein the housing is a rocker arm pivot for the rocker arm.

14. The variable-length assembly of claim 1, wherein the housing is a bleeder brake housing secured to an engine and including a bore defined therein to receive the piston and actuating plate.

15. The variable-length assembly of claim 1, wherein the actuating plate is fixed relative to the housing.

16. The variable-length assembly of claim 1, wherein at least one of the piston and the housing includes an anti-rotation element for preventing rotation of the piston relative to the housing.

17. The variable-length assembly of claim 1, wherein at least one of the actuating plate and the piston includes an anti-rotation element for preventing rotation relative to the housing.

18. The variable-length assembly of claim 1, wherein at least one of the actuating plate and the piston includes a limiter for limiting rotation relative to the housing, wherein the limiter is adjustable, relative to the housing, to set lash in the valve train.

19. The variable-length assembly of claim 1, wherein the piston includes a shoulder and wherein the retaining assembly includes a retaining plate adapted to engage the shoulder and secure the piston to the housing.

20. The variable-length assembly of claim 19, further comprising an adjustment screw abutting the actuating plate for adjusting a position thereof within the housing.

21. The variable length assembly of claim 1, wherein the actuating assembly includes one of a solenoid, a stepper motor, a variable position actuator or a variable force actuator.

22. The variable-length assembly of claim 1, further comprising an actuating ring cooperating with the piston to cause rotational movement of the piston relative to the actuating plate.

23. The variable-length assembly of claim 1, wherein the actuation assembly comprises a gear interface for rotating one of the piston or actuating plate.

24. The variable-length assembly of claim 23, wherein the gear interface applies a substantially constant rotational motion to one of the piston or actuating plate.

25. The variable-length assembly of claim 1, wherein at least one of the actuating plate working surface and the piston working surface include at least one ramp having the form of a variable pitch helix.

26. The variable-length assembly of claim 25, wherein the at least one ramp extends for about 50 degrees of a circumference of at least one of the actuating plate and the piston.

27. The variable-length assembly of claim 25, wherein the at least one ramp has pitch and curvature that are different at different radii of at least one of the actuating plate and the piston.

28. The variable-length assembly of claim 1, further comprising a biasing element for biasing the piston in a direction towards the actuating plate.

29. The variable-length assembly of claim 1, further comprising a biasing element for biasing the piston in a direction away from the actuating plate.

* * * * *